US009794712B2

(12) United States Patent
Melkote et al.

(10) Patent No.: US 9,794,712 B2
(45) Date of Patent: Oct. 17, 2017

(54) MATRIX DECOMPOSITION FOR RENDERING ADAPTIVE AUDIO USING HIGH DEFINITION AUDIO CODECS

(71) Applicant: Dolby Laboratories Licensing Corporation, San Francisco, CA (US)

(72) Inventors: Vinay Melkote, Bangalore (IN); Malcolm James Law, Steyning (GB)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/306,454

(22) PCT Filed: Apr. 23, 2015

(86) PCT No.: PCT/US2015/027239
§ 371 (c)(1),
(2) Date: Oct. 24, 2016

(87) PCT Pub. No.: WO2015/164575
PCT Pub. Date: Oct. 29, 2015

(65) Prior Publication Data

US 2017/0048639 A1 Feb. 16, 2017

Related U.S. Application Data

(60) Provisional application No. 61/984,292, filed on Apr. 25, 2014.

(51) Int. Cl.

| | |
|---|---|
| ***G10L 19/008*** | (2013.01) |
| ***H04R 3/02*** | (2006.01) |
| ***H04S 3/02*** | (2006.01) |

(52) U.S. Cl.
CPC ..... *H04S 3/02* (2013.01); *G10L 19/008* (2013.01); *H04S 2400/03* (2013.01); *H04S 2400/11* (2013.01)

(58) Field of Classification Search
CPC ..... G10L 19/008; H04S 3/02; H04S 2400/03; H04S 2400/11
See application file for complete search history.

(56) References Cited

U.S. PATENT DOCUMENTS

| | | | |
|---|---|---|---|
| 6,611,212 | B1 | 8/2003 | Craven |
| 2016/0241981 | A1 | 8/2016 | Law |

FOREIGN PATENT DOCUMENTS

| | | |
|---|---|---|
| EP | 1400955 | 12/2008 |
| RS | 1332 U | 8/2013 |
| WO | 00/02357 | 1/2000 |

(Continued)

OTHER PUBLICATIONS

Meyer, Carl D "Matrix Analysis and Applied Linear Algebra" Siam Publishers, Jan. 1, 2000.

(Continued)

*Primary Examiner* — Brenda Bernardi

(57) ABSTRACT

A method of decomposing a matrix of dimension L-by-N, where L is less than or equal to N, into a sequence of N-by-N unit primitive matrices and a permutation matrix comprising a sequence that is the product of the primitive matrices and the permutation matrix, containing L rows that are substantially close to the provided L-by-N matrix, where the choice of the permutation matrix and the indices of the non-trivial rows in the primitive matrices are chosen to limit the coefficient values in the primitive matrices.

20 Claims, 3 Drawing Sheets

(56) References Cited

FOREIGN PATENT DOCUMENTS

| | | |
|---|---|---|
| WO | 00/60746 | 10/2000 |
| WO | 2005/031597 | 4/2005 |
| WO | 2008/078973 | 7/2008 |
| WO | 2009/025676 | 2/2009 |
| WO | 2012/045203 | 4/2012 |
| WO | 2013/192111 | 12/2013 |
| WO | 2014/014600 | 1/2014 |
| WO | 2015/048387 | 4/2015 |

OTHER PUBLICATIONS

DVD Specifications: MLP Reference Information, Version 1.01, Jan. 2008.

Gerzon, M.A. et al "The MLP Lossless Compression System for PCM Audio" JAES vol. 52 Issue 3, pp. 243-260, Mar. 15, 2004.

Stanojevic, Tomislav "3-D Sound in Future HDTV Projection Systems," 132nd SMPTE Technical Conference, Jacob K. Javits Convention Center, New York City, New York, Oct. 13-17, 1990, 20 pages.

Stanojevic, Tomislav "Surround Sound for a New Generation of Theaters," Sound and Video Contractor, Dec. 20, 1995, 7 pages.

Stanojevic, Tomislav "Virtual Sound Sources in the Total Surround Sound System," SMPTE Conf. Proc.,1995, pp. 405-421.

Stanojevic, Tomislav et al. "Designing of TSS Halls," 13th International Congress on Acoustics, Yugoslavia, 1989, pp. 326-331.

Stanojevic, Tomislav et al. "Some Technical Possibilities of Using the Total Surround Sound Concept in the Motion Picture Technology," 133rd SMPTE Technical Conference and Equipment Exhibit, Los Angeles Convention Center, Los Angeles, California, Oct. 26-29, 1991, 3 pages.

Stanojevic, Tomislav et al. "The Total Surround Sound (TSS) Processor," SMPTE Journal, Nov. 1994, pp. 734-740.

Stanojevic, Tomislav et al. "The Total Surround Sound System (TSS System)", 86th AES Convention, Hamburg, Germany, Mar. 7-10, 1989, 21 pages.

Stanojevic, Tomislav et al. "TSS Processor" 135th SMPTE Technical Conference, Los Angeles Convention Center, Los Angeles, California, Society of Motion Picture and Television Engineers, Oct. 29-Nov. 2, 1993, 22 pages.

Stanojevic, Tomislav et al. "TSS System and Live Performance Sound" 88th AES Convention, Montreux, Switzerland, Mar. 13-16, 1990, 27 pages.

MATRIX DECOMPOSITION FOR RENDERING ADAPTIVE AUDIO USING HIGH DEFINITION AUDIO CODECS

CROSS REFERENCE TO RELATED APPLICATION

This application claims priority to U.S. Provisional Patent Application No. 61/984,292 filed on 25 Apr. 2014, which is hereby incorporated by reference in its entirety.

FIELD OF THE INVENTION

One or more embodiments relate generally to arithmetic matrix operations, and more specifically to decomposing a multi-dimensional matrix into a sequence of N-by-N unit primitive matrices and a permutation matrix; and wherein a practical application of such embodiments is in high definition audio signal processing for defining matrix specification to optimally downmix or upmix adaptive audio content using high definition audio codecs.

BACKGROUND

New professional and consumer-level audio-visual (AV) systems (such as the Dolby® Atmos™ system) have been developed to render hybrid audio content using a format that includes both audio beds (channels) and audio objects. Audio beds refer to audio channels that are meant to be reproduced in predefined, fixed speaker locations (e.g., 5.1 or 7.1 surround) while audio objects refer to individual audio elements that exist for a defined duration in time and have spatial information describing the position, velocity, and size (as examples) of each object. During transmission beds and objects can be sent separately and then used by a spatial reproduction system to recreate the artistic intent using a variable number of speakers in known physical locations. Based on the capabilities of an authoring system there may be tens or even hundreds of individual audio objects (static and/or time-varying) that are combined during rendering to create a spatially diverse and immersive audio experience. In an embodiment, the audio processed by the system may comprise channel-based audio, object-based audio or object and channel-based audio. The audio comprises or is associated with metadata that dictates how the audio is rendered for playback on specific devices and listening environments. In general, the terms "hybrid audio" or "adaptive audio" are used to mean channel-based and/or object-based audio signals plus metadata that renders the audio signals using an audio stream plus metadata in which the object positions are coded as a three-dimensional (3D) position in space.

Adaptive audio systems thus represent the sound scene as a set of audio objects in which each object is comprised of an audio signal (waveform) and time varying metadata indicating the position of the sound source. Playback over a traditional speaker set-up such as a 7.1 arrangement (or other surround sound format) is achieved by rendering the objects to a set of speaker feeds. The process of rendering comprises in large part (or solely) a conversion of the spatial metadata at each time instant into a corresponding gain matrix, which represents how much of each of the object feeds into a particular speaker. Thus, rendering "N" audio objects to "M" speakers at time "t" (t) can be represented by the multiplication of a vector x(t) of length "N", comprised of the audio sample at time t from each object, by an "M-by-N" matrix A(t) constructed by appropriately interpreting the associated position metadata (and any other metadata such as object gains) at time t. The resultant samples of the speaker feeds at time tare represented by the vector y(t). This is shown below in Eq. 1:

$$\underbrace{\begin{bmatrix} y_0(t) \\ y_1(t) \\ \vdots \\ y_{M-1}(t) \end{bmatrix}}_{y(t)} = \underbrace{\begin{bmatrix} a_{00}(t) & a_{01}(t) & a_{02}(t) & \dots & a_{0,N-1}(t) \\ a_{10}(t) & \vdots & \vdots & \vdots & \vdots \\ \vdots & \vdots & \vdots & \vdots & \vdots \\ a_{M-1,0}(t) & \vdots & \vdots & \vdots & a_{M-1,N-1}(t) \end{bmatrix}}_{A(t)} \underbrace{\begin{bmatrix} x_0(t) \\ x_1(t) \\ x_2(t) \\ \vdots \\ \vdots \\ x_{N-1}(t) \end{bmatrix}}_{x(t)} \quad \text{(Eq. 1)}$$

The matrix equation of Eq. 1 above represents an adaptive audio (e.g., Atmos) rendering perspective, but it can also represent a generic set of scenarios where one set of audio samples is converted to another set by linear operations. In an extreme case A(t) is a static matrix and may represent a conventional downmix of a set of audio channels x(t) to a fewer set of channels y(t). For instance, x(t) could be a set of audio channels that describe a spatial scene in an Ambisonics format, and the conversion to speaker feeds y(t) may be prescribed as multiplication by a static downmix matrix. Alternatively, x(t) could be a set of speaker feeds for a 7.1 channel layout, and the conversion to a 5.1 channel layout may be prescribed as multiplication by a static downmix matrix.

To provide audio reproduction that is as accurate as possible, adaptive audio systems are often used with high-definition audio codecs (coder-decoder) systems, such as Dolby TrueHD. As an example of such codecs, Dolby TrueHD is an audio codec that supports lossless and scalable transmission of audio signals. The source audio is encoded into a hierarchy of substreams where only a subset of the substreams need to be retrieved from the bitstream and decoded, in order to obtain a lower dimensional (or downmix) presentation of the spatial scene, and when all the substreams are decoded the resultant audio is identical to the source audio. Although embodiments may be described and illustrated with respect to TrueHD systems, it should be noted that any other similar HD audio codec system may also be used. The term "TrueHD" is thus meant to include all possible HD type codecs. Technical details of Dolby TrueHD, and the Meridian Lossless Packing (MLP) technology on which it is based, are well known. Aspects of TrueHD and MLP technology are described in U.S. Pat. No. 6,611,212, issued Aug. 26, 2003, and assigned to Dolby Laboratories Licensing Corp., and the paper by Gerzon, et al., entitled "The MLP Lossless Compression System for PCM Audio," J. AES, Vol. 52, No. 3, pp. 243-260 (March 2004).

The TrueHD format supports specification of downmix matrices. In typical use, the content creator of a 7.1 channel audio program specifies a static matrix to downmix the 7.1 channel program to a 5.1 channel mix, and another static matrix to downmix the 5.1 channel downmix to a 2 channel (stereo) downmix. Each static downmix matrix may be converted to a sequence of downmix matrices (each matrix in the sequence for downmixing a different interval in the program) in order to achieve clip-protection. However, each matrix in the sequence (or metadata determining each matrix in the sequence) is transmitted to the decoder, and the decoder does not perform interpolation on any previously specified downmix matrix to determine a subsequent matrix in a sequence of downmix matrices for a program.

Given a downmix matrix specification (e.g., a static specification A that is 2*3 in dimension), the objective of the encoder is to design the output matrices (and hence the input matrices), and output channel assignments (and hence the input channel assignment) so that the resultant internal audio is hierarchical, i.e., the first two internal channels are sufficient to derive the 2-channel presentation, and so on; and the matrices of the top most substream are exactly invertible so that the input audio is exactly retrievable. However, it should be noted that computing systems work with finite precision and inverting an arbitrary invertible matrix exactly often requires very large precision calculations. Thus, downmix operations using TrueHD codec systems generally require a large number of bits to represent matrix coefficients.

What is needed, therefore, is an HD codec system that performs down- and up-mixing operations without requiring large precision calculations in order to prevent the use of large numbers of bits to represent matrix coefficients in rendering adaptive audio content.

What is further needed is a system that enables the transmission of adaptive audio content (e.g., Dolby Atmos) via high-definition codec formats (e.g., Dolby TrueHD), with a substream structure that supports decoding some standard downmixes (e.g., 2 ch, 5.1 ch, 7.1 ch) by legacy devices, while support for decoding lossless adaptive audio may be available only in new decoding devices.

Certain high-definition audio formats, such as TrueHD may address the problem of requiring large precision calculations by constraining the output matrices (and input matrices) to be of the type denoted "primitive matrices." What is yet further needed, however, is a method of decomposing downmix specification matrices into primitive matrices with coefficient values that do not exceed the syntax constraints of the audio processing system.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions. Dolby, Dolby TrueHD, and Atmos are trademarks of Dolby Laboratories Licensing Corporation.

BRIEF SUMMARY OF EMBODIMENTS

Embodiments are directed to a method of decomposing a multi-dimensional matrix into a sequence of unit primitive matrices and a permutation matrix comprising receiving a matrix of dimension L-by-N, where L is less than or equal to N, deriving from the L-by-N matrix a sequence of N-by-N unit primitive matrices and a permutation matrix, wherein the product of the primitive matrices and the permutation matrix contains L rows that are substantially close to the L-by-N matrix. The permutation matrix and the indices of the non-trivial rows in the primitive matrices are configured such that the absolute coefficient values in the primitive matrices are limited with respect to a maximum allowed coefficient value of the signal processing system. Such a maximum allowed coefficient value may be determined by a value limit of a bitstream transmitting data from the encoder to the decoder, or to some other processing limit of the system. The matrix decomposition process is intended to operate on matrices containing any type of data and for any type of application. Certain embodiments described herein apply the matrix decomposition process to audio signal data rendered through discrete channel outputs, but embodiments are not so limited. In this method, the process of deriving the sequence of primitive matrices and the permutation matrix is iterative, and further comprises defining the permutation matrix to be an identity matrix initially, and iteratively modifying the L-by-N matrix to account for the configured primitive matrices and the permutation matrix up to a previous iteration to generate a modified L-by-N matrix in each iteration by selecting a subset of rows of the modified L-by-N matrix, constructing a subset of the primitive matrices, and reordering at least some of the columns of the permutation matrix so that the product of the primitive matrices and permutation matrix contains rows that are substantially similar to the chosen subset of rows in the modified L-by-N matrix. The process of choosing the columns of the permutation matrix that are to be reordered involves comparing determinants of sub-matrices of the modified L-by-N matrix and choosing the ordering that yields a determinant that is larger than a threshold dependent on the maximum allowed coefficient value, or the columns of the permutation matrix are chosen to yield the largest determinant. The subset of rows of the modified L-by-N matrix is determined by comparing determinants of sub-matrices of the L-by-N matrix and choosing rows that ensure the existence of determinants larger than the threshold when the ordering of columns of the permutation matrix is determined. The reordering of the columns of the permutation matrix may additionally depend on maximizing the absolute values of determinants that are evaluated in subsequent iterations.

The L-by-N matrix is equivalent to an $M_0$-by-N matrix $A_0$ rotated by applying an L-by-$M_0$ rotation matrix Z, wherein L is less than or equal to $M_0$, and wherein the rotation matrix Z is constructed such that that each linear transformation in a hierarchy of linear transformations $A_0$ to $A_1$ to $A_2$ so on to $A_{k-1}$ for K greater than or equal to one, of the matrix $A_0$, is achieved by linearly combining a continuous series of rows of the rotated L-by-N matrix. The matrices $A_k$ for k greater than or equal to zero and k less than K, are of dimensions $M_k$-by-$M_{k-1}$ and the rank of $A_k$ is $M_k$. In one embodiment the rotation matrix Z is constructed by stacking up subsets of columns in products of sequences comprising:

$$A_{K-1}*\ldots*A_2*A_1*I,\ldots$$
$$A_k*\ldots*A_2*A_1*I,\ldots$$
$$A_1*I,$$
$$I,$$

In the above expression, I is the identity matrix of dimension $M_0$-by-$M_0$. It should be noted that an identity matrix is also a primitive matrix, albeit a trivial one. That is, it has no non-trivial row as such. Alternatively, any row of an identity matrix can be marked as non-trivial if such identification of a non-trivial row of the identity matrix benefits any of the embodiments described herein. For instance, say at time t1, two non-trivial primitive matrices were determined P0 and P1, and at time t2 three primitive matrices were determined P0', P1', P2'. Assuming P0 and P0' had the same rows to be non-trivial, and P1 and P1' had the same rows to be non-trivial, there is still a problem for interpolating primitive matrices between time t1 and t2, since there is no primitive matrix corresponding to P2' at time t1. In this case, one may insert a P2 at time t1 which is simply the identity matrix, and assume that the non-trivial row in P2 is the one which has the same row index as the non-trivial row in P2'.

In another embodiment, the construction of the rotation matrix Z is an iterative procedure, and further comprises processing one sequence product comprising $A_k^* \ldots *A_2*A_1*A_0$ per iteration, starting from the deepest sequence where k equals K−1, determining a $k^{th}$ set of vectors that span the row space of the one sequence that is orthogonal to the row space of the product of a partial rotation Z determined in a previous iteration and the first rendering matrix $A_0$, and augmenting the rotation matrix Z with rows that, when multiplied with $A_0$, results in vectors that are substantially close to the $k^{th}$ set of vectors. The $k^{th}$ set of vectors may be orthonormal to each other. Furthermore, the process of determining the $k^{th}$ set of vectors may involve a singular value decomposition. The rotation matrix Z is generally designed to minimize cross correlation between the columns of the rotated L-by-N matrix, or to minimize the 12 norm of the columns of the rotated L-by-N matrix, or to minimize the absolute value of coefficients in the N-by-N primitive matrices. The rotation matrix may be designed to effectively apply a gain on one or more columns of a resulting L-by-N matrix so that the coefficients in the primitive matrices of the decomposition are limited in value.

In an embodiment, the decomposition process is part of a high definition audio encoder wherein the permutation matrix represents a channel assignment that reorders N input channels, and further comprises applying the N-by-N primitive matrices to the reordered N input audio channels to create internal channels encoded into the bitstream, and receiving at least a portion of the internal channels to losslessly recover, when required, the N input audio channels maybe losslessly recovered from the internal channels. The sequence product $A_k*A_{k-1} \ldots *A_2*A_1*A_0$, for each k, represents a rendering matrix that linearly transforms N input channels into $M_k$ presentation channels, and the $M_k$-channel presentation may be obtained by output matrices in the bitstream applied only to a subset of the set of internal channels. The output matrices corresponding to one or more presentation in the sequence may be in a legacy bitstream format that is compatible with legacy decoding devices, while at least the input primitive matrices conform to a different bitstream syntax. The input audio typically comprises adaptive audio content, and the $M_0$-by-N matrix $A_0$ is a time-varying matrix that adapts to changing spatial metadata. In this case, the matrices $A_0$, $A_1$ to $A_{K-1}$ are rendering matrices specified at time t1, and a second set of matrices $B_0$, $B_1$ to $B_{K-1}$, are rendering matrices specified at time t2, where $B_0$ is the same dimension as $A_0$, and $B_1$ to $B_{K-1}$ are substantially the same as $A_1$ to $A_{K-1}$ respectively, an L-by-N matrix is constructed both at time t1 and t2, by applying the same rotation Z on $A_0$ and $B_0$ respectively, a decomposition of the L-by-N matrix into N*N primitive matrices and a channel assignment is determined at both t1 and t2, and a single set of output matrices is determined that transforms internal channels to presentation channels for each presentation at both instants of time t1 and t2. When the number of primitive matrices, channel assignment, and the index of the non-trivial rows in the primitive matrices is exactly the same at both t1 and t2, primitive matrices at intermediate time instants are derived by interpolating the primitive matrices at time t1 and t2. The rotation Z may be determined based on the specified matrices $A_0$, $A_1$ to $A_{K-1}$ at time t1 and reused at time t2, or so that the maximum absolute value of coefficients in primitive matrices at either time instant t1 and t2 is limited.

Embodiments are further directed to systems and articles of manufacture that perform or embody processing commands that perform or implement the above-described method acts.

INCORPORATION BY REFERENCE

Each publication, patent, and/or patent application mentioned in this specification is herein incorporated by reference in its entirety to the same extent as if each individual publication and/or patent application was specifically and individually indicated to be incorporated by reference.

BRIEF DESCRIPTION OF THE DRAWINGS

In the following drawings like reference numbers are used to refer to like elements. Although the following figures depict various examples, the one or more implementations are not limited to the examples depicted in the figures.

DETAILED DESCRIPTION

Systems and methods are described for decomposing downmix or upmix matrices in an adaptive audio processing system into a sequence of primitive matrices and configuring the primitive matrices such that the absolute coefficient values in the non-trivial rows of the primitive matrices are limited with respect to a maximum allowed coefficient value of the audio processing system. Aspects of the one or more embodiments described herein may be implemented in an audio or audio-visual (AV) system that processes source audio information in a mixing, rendering and playback system that includes one or more computers or processing devices executing software instructions. Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

Figure 1:
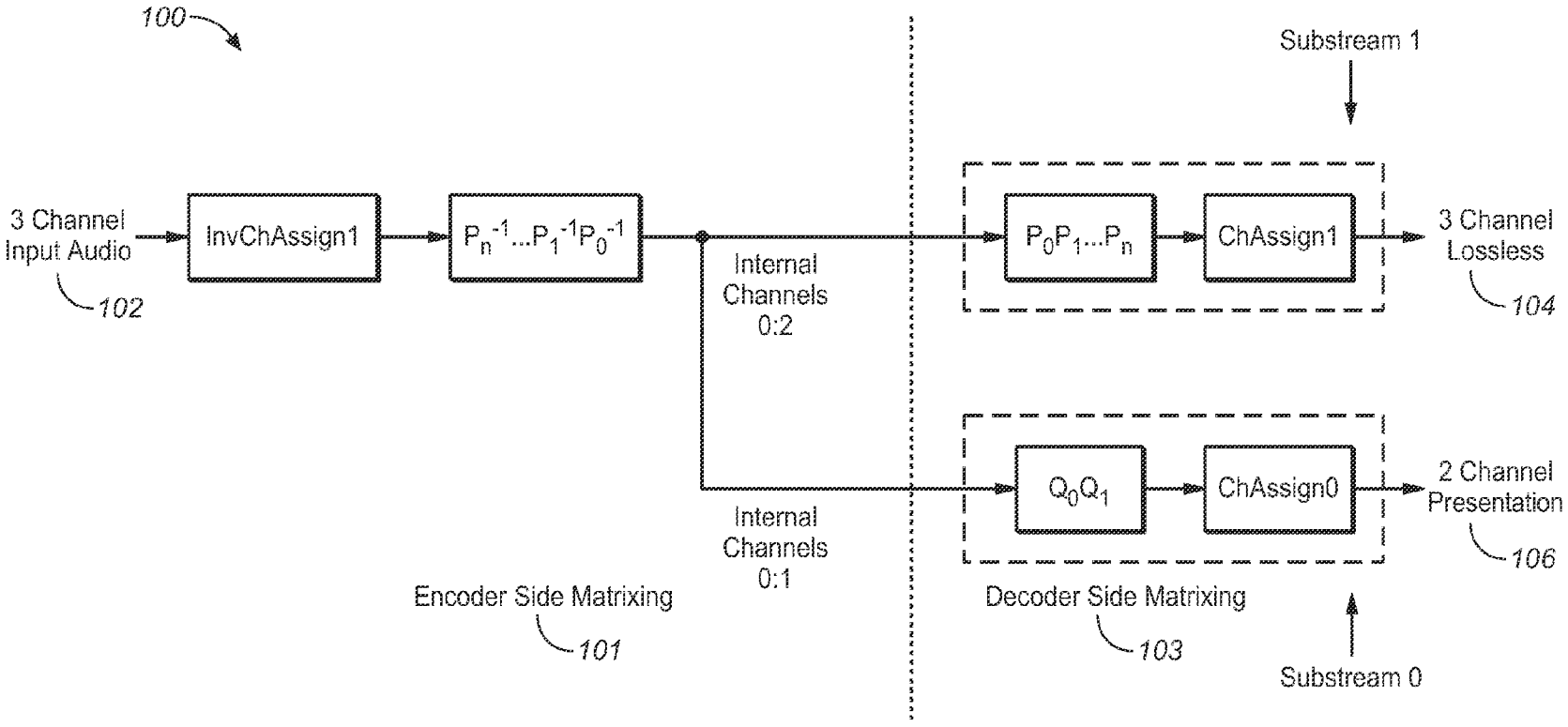
FIG. 1 illustrates a schematic of matrixing operations in a high-definition audio encoder and decoder for a particular downmixing scenario.

Embodiments are directed to a matrix decomposition method for use in encoder/decoder systems transmitting adaptive audio content via a high-definition audio (e.g., TrueHD) format using substreams containing downmix matrices and channel assignments. FIG. 1 shows an example of a downmix system for an input audio signal having three input channels packaged into two substreams 104 and 106, where the first substream is sufficient to retrieve a two-channel downmix of the original three channels, and the two substreams together enable retrieving the original three-channel audio losslessly. As shown in FIG. 1, encoder 101 and decoder-side 103 perform matrixing operations for input stream 102 containing two substreams denoted Substream 1 and Substream 0 that produce lossless or downmixed outputs 104 and 106, respectively. Substream 1 comprises matrix sequence $P_0, P_1, \ldots P_n$, and a channel assignment matrix ChAssign1; and Substream 0 comprises matrix sequence $Q_0, Q_1$ and a channel assignment matrix ChAssign0. Substream 1 reproduces a lossless version of the original input audio original as output 106, and Substream 0 produces a downmix presentation 106. A downmix decoder may decode only substream 0.

At the encoder 101, the three input channels are converted into three internal channels (indexed 0, 1, and 2) via a sequence of (input) matrixing operations. The decoder 103 converts the internal channels to the required downmix 106 or lossless 104 presentations by applying another sequence of (output) matrixing operations. Essentially, the audio (e.g., TrueHD) bitstream contains a representation of these three internal channels and sets of output matrices, one corresponding to each substream. For instance, the Substream 0 contains the set of output matrices $Q_0$, $Q_1$ that are each of dimension 2*2 and multiply a vector of audio samples of the first two internal channels (ch0 and ch1). These combined with a corresponding channel permutation (equivalent to multiplication by a permutation matrix) represented here by the box titled "ChAssign0" yield the required two channel downmix of the three original audio channels. The sequence/product of matrixing operations at the encoder and decoder is equivalent to the required downmix matrix specification that transforms the three input audio channels to the downmix representation.

The output matrices of Substream 1 ($P_0, P_1, \ldots, P_n$), along with a corresponding channel permutation (ChAssign1) result in converting the internal channels back into the input three-channel audio. In order that the output three-channel audio is exactly the same as the input three-channel audio (lossless characteristic of the system), the matrixing operations at the encoder should be exactly (including quantization effects) the inverse of the matrixing operations of the lossless substream in the bitstream. Thus, for system 100, the matrixing operations at the encoder have been depicted as the inverse matrices in the opposite sequence $P^{-1}, \ldots, P^{-1}, P^{-1}$. Additionally, note that the encoder applies the inverse of the channel permutation at the decoder through the "InvChAssign 1 " (inverse channel assignment 1) process at the encoder-side. For the example system 100 of FIG. 1, the term "substream" is used to encompass the channel assignments and matrices corresponding to a given presentation, e.g., downmix or lossless presentation. In practical applications, Substream 0 may have a representation of the samples in the first two internal channels (0:1) and Substream 1 will have a representation of samples in the third internal channel (0:2). Thus a decoder that decodes the presentation corresponding to Substream 1 (the lossless presentation) will have to decode both substreams. However, a decoder that produces only the stereo downmix may decode substream 0 alone. In this manner, the TrueHD format is scalable or hierarchical in the size of the presentation obtained.

Given a downmix matrix specification (for instance, in this case it could be a static specification A that is 2*3 in dimension), the objective of the encoder is to design the output matrices (and hence the input matrices), and output channel assignments (and hence the input channel assignment) so that the resultant internal audio is hierarchical, i.e., the first two internal channels are sufficient to derive the 2-channel presentation, and so on; and the matrices of the top most substream are exactly invertible so that the input audio is exactly retrievable. However, it should be noted that computing systems work with finite precision and inverting an arbitrary invertible matrix exactly often requires very large precision calculations. Thus, downmix operations using TrueHD codec systems generally require a large number of bits to represent matrix coefficients.

As stated previously, TrueHD (and other possible HD audio formats) try to minimize the precision requirements of inverting arbitrary invertible matrices by constraining the matrices to be primitive matrices. A primitive matrix P of dimension N*N is of the form shown in Eq. 2 below:

$$P = \begin{bmatrix} 1 & 0 & \ddots & \ddots & 0 \\ 0 & 1 & 0 & \ddots & \ddots \\ \alpha_0 & \alpha_1 & \alpha_2 & \ddots & \alpha_{N-1} \\ \vdots & \ddots & \ddots & \ddots & \ddots \\ 0 & 0 & 0 & 0 & 1 \end{bmatrix} \quad \text{(Eq. 2)}$$

This primitive matrix is identical to the identity matrix of dimension N*N except for one (non-trivial) row. When a primitive matrix, such as P, operates on or multiplies a vector such as x(t) the result is the product Px(t), another N-dimensional vector that is exactly the same as x(t) in all elements except one. Thus each primitive matrix can be associated with a unique channel, which it manipulates, or on which it operates. A primitive matrix only alters one channel of a set (vector) of samples of audio program channels, and a unit primitive matrix is also losslessly invertible due to the unit values on the diagonal.

If $\alpha_2=1$ (resulting in a unit diagonal in P), it is seen that the inverse of P is exactly as shown in Eq. 3 below:

$$P^{-1} = \begin{bmatrix} 1 & 0 & \ddots & \ddots & 0 \\ 0 & 1 & 0 & \ddots & \ddots \\ -\alpha_0 & -\alpha_1 & 1 & \ddots & -\alpha_{N-1} \\ \vdots & \ddots & \ddots & \ddots & \ddots \\ 0 & 0 & 0 & 0 & 1 \end{bmatrix} \quad \text{(Eq. 3)}$$

If the primitive matrices $P_0, P_1, \ldots, P_n$ in the decoder of FIG. 1 have unit diagonals the sequence of matrixing operations $P_n^{-1}, \ldots, P_1^{-1}, P_0^{-1}$ at the encoder and $P_0, P_1, \ldots, P_n$ at the decoder can be implemented by finite precision circuits. If $\alpha_2=-1$ it is seen that the inverse of P is itself, and in this case too the inverse can be implemented by finite precision circuits. The description will refer to primitive matrices that have a 1 or −1 as the element the non-trivial row shares with the diagonal, as unit primitive matrices. Thus, the diagonal of a unit primitive matrix consists of all positive ones, +1, or all negative ones, −1, or some positive ones and some negative ones. Although unit primitive matrix refers to a primitive matrix whose non-trivial row has a diagonal element of +1, all references to unit primitive matrices herein, including in the claims, are intended to cover the more generic case where a unit primitive matrix can have a non-trivial row whose shared element with the diagonal is +1 or −1.

A channel assignment or channel permutation refers to a reordering of channels. A channel assignment of N channels can be represented by a vector of N indices $c_N=[c_0\ c_1\ \ldots\ c_{N-1}]$, $c_i \epsilon \{0, 1, \ldots, N-1\}$ and $c_i \neq c_j$ if $i \neq j$. In other words the channel assignment vector contains the elements 0, 1, 2, . . . , N−1 in some particular order, with no element repeated. The vector indicates that the original channel i will be remapped to the position $c_i$. Clearly applying the channel assignment $c_N$ to a set of N channels at time t, can be represented by multiplication with an N*N permutation matrix [1]$C_N$ whose column i is a vector of N elements with all zeros except for a 1 in the row $c_i$.

For instance, the 2-element channel assignment vector [1 0] applied to a pair of channels Ch0 and Ch1 implies that the first channel Ch0' after remapping is the original Ch1 and the second channel Ch1' after remapping is Ch0. This can be represented by the two dimensional permutation matrix $$C_2 = \begin{bmatrix} 0 & 1 \\ 1 & 0 \end{bmatrix}$$

which when applied to a vector $$x = \begin{bmatrix} x_0 \\ x_1 \end{bmatrix}$$

where $x_0$ is a sample of Ch0 is and $x_1$ is a sample of Ch1, results in the vector $$\begin{bmatrix} x_0 \\ x_1 \end{bmatrix} = C_2 x$$

whose elements are permuted versions of the original vector.

Note that the inverse of a permutation matrix exists, is unique and is itself a permutation matrix. In fact, the inverse of a permutation matrix is its transpose. In other words, the inverse channel assignment of a channel assignment $c_N$ is the unique channel assignment $d \ldots d_0\ d_1 \ldots d_{N-1}]$ where $d_i=j$ if $c_j=i$, so that $d_N$ when applied to the permuted channels restores the original order of channels.

As an example, consider the system 100 of FIG. 1A in which the encoder is given the 2*3 downmix specification:

$$A = \begin{bmatrix} 0.707 & 0.2903 & 0.9569 \\ 0.707 & 0.9569 & 0.2902 \end{bmatrix}$$

so that:

$$\begin{bmatrix} dmx0 \\ \\ dmx1 \end{bmatrix} = A \begin{bmatrix} ch0 \\ ch1 \\ ch2 \end{bmatrix}$$

where dmx0 and dmx1 are output channels from a decoder, and ch0, ch1, ch2 are the input channels (e.g., objects). In this case, the encoder may find three unit primitive matrices $P_0^{-1}$, $P_1^{-1}$, $P_2^{-1}$ (as shown below) and a given input channel assignment $d_3$=[2 0 1] which defines a permutation $D_3$ so that the product of the sequence is as follows:

$$\begin{bmatrix} 0.707 & 0.2903 & 0.9569 \\ 0.707 & 0.9569 & 0.2903 \\ 1 & -1.004 & 4.890 \end{bmatrix} = \underbrace{\begin{bmatrix} 1 & 0 & 0 \\ 1.666 & 1 & -0.4713 \\ 0 & 0 & 1 \end{bmatrix}}_{P_0^{-1}} \underbrace{\begin{bmatrix} 1 & -2.5 & 0.707 \\ 0 & 1 & 0 \\ 0 & 0 & 1 \end{bmatrix}}_{P_1^{-1}} \underbrace{\begin{bmatrix} 1 & 0 & 0 \\ 0 & 1 & 0 \\ -1.003 & 4.889 & 1 \end{bmatrix}}_{P_2^{-1}} \underbrace{\begin{bmatrix} 0 & 1 & 0 \\ 0 & 0 & 1 \\ 1 & 0 & 0 \end{bmatrix}}_{D_3}$$

As can be seen in the above example, the first two rows of the product are exactly the specified downmix matrix A. In other words if the sequence of these matrices is applied to the three input audio channels (ch0, ch1, ch2), the system produces three internal channels (ch0', ch1', ch 2'), with the first two channels exactly the same as the 2-channel downmix desired. In this case the encoder could choose the output primitive matrices $Q_0$, $Q_1$ of the downmix substream as identity matrices, and the two-channel channel assignment (ChAssign0 in FIG. 1) as the identity assignment [0 1], i.e., the decoder would simply present the first two internal channels as the two channel downmix. It would apply the inverse of the primitive matrices $P_0^{-1}$, $P_1^{-1}$, $P_2^{-1}$ given by $P_0$, $P_1$, $P_2$ to (ch0 ', ch1 ', ch2 ') and then the inverse of the channel assignment $d_3$ given by $c_3$=[1 2 0] to obtain the original input audio channels (ch0, ch1, ch2). This example represents first decomposition method, referred to as "decomposition 1."

In a different decomposition, referred to as "decomposition 2," the system may use two unit primitive matrices $P_0^{-1}$, $P_1^{-1}$ (shown below) and an input channel assignment $d_3$=[2 1 0] which defines a permutation $D_3$ so that the product of the sequence is as follows:

$$\begin{bmatrix} 0.7388 & 0.3034 & 1 \\ 0.8137 & 1.1013 & 0.3340 \\ 1 & 0 & 0 \end{bmatrix} = \underbrace{\begin{bmatrix} 1 & 0 & 0 \\ 0.3340 & 1 & 0.5669 \\ 0 & 0 & 1 \end{bmatrix}}_{P_0^{-1}} \underbrace{\begin{bmatrix} 1 & 0.3034 & 0.7388 \\ 0 & 1 & 0 \\ 0 & 0 & 1 \end{bmatrix}}_{P_1^{-1}} \underbrace{\begin{bmatrix} 0 & 0 & 1 \\ 0 & 1 & 0 \\ 1 & 0 & 0 \end{bmatrix}}_{D_3}$$

In this case, note that the required specification A can be achieved by multiplying the first two rows of the above sequence with the output primitive matrices for the two channel substream chosen as $Q_0$,$Q_1$ below:

$$\begin{bmatrix} 0.707 & 0.2903 & 0.9569 \\ 0.707 & 0.9569 & 0.2902 \end{bmatrix} = \underbrace{\begin{bmatrix} 1 & 0 \\ 0 & 0.8689 \end{bmatrix}}_{Q_1} \underbrace{\begin{bmatrix} 0.9569 & 0 \\ 0 & 1 \end{bmatrix}}_{Q_0} \begin{bmatrix} 0.7388 & 0.3034 & 1 \\ 0.8137 & 1.1013 & 0.3340 \end{bmatrix}$$

Unlike in the original decomposition 1, the encoder achieves the required downmix specification by designing a combination of both input and output primitive matrices. The encoder applies the input primitive matrices (and channel assignment $d_3$) to the input audio channels to create a set of internal channels that are transmitted in the bitstream. At the decoder, the internal channels are reconstructed and output matrices $Q_0$, $Q_1$ are applied to get the required downmix audio. If the lossless original audio is needed the inverse of the primitive matrices $P_0^{-1}$, $P_1^{-1}$ given by $P_0$, $P_1$ are applied to the internal channels and then the inverse of the channel assignment $d_3$ given by $c_3$=[2 1 0] to obtain the original input audio channels.

In both the first and second decompositions described above, the system has not employed the flexibility of using output channel assignment for the downmix substream, which is another degree of freedom that could have been exploited in the decomposition of the required specification A. Thus, different decomposition strategies can be used to achieve the same specification A.

Aspects of the above-described primitive matrix technique can be used to mix (upmix or downmix) TrueHD content for rendering in different listening environments. Embodiments are directed to systems and methods that enable the transmission of adaptive audio content via TrueHD, with a substream structure that supports decoding some standard downmixes such as 2 ch, 5.1 ch, 7.1 ch by legacy devices, while support for decoding lossless adaptive audio may be available only in new decoding devices.

It should be noted that a legacy device as any device that decodes the downmix presentations already embedded in TrueHD instead of decoding the lossless objects and then re-rendering them to the required downmix configuration. The device may in fact be an older device that is unable to decode the lossless objects or it may be a device that consciously chooses to decode the downmix presentations. Legacy devices may have been typically designed to receive content in older or legacy audio formats. In the case of Dolby TrueHD, legacy content may be characterized by well-structured time-invariant downmix matrices with at most eight input channels, for instance, a standard 7.1 ch to 5.1 ch downmix matrix. In such a case, the matrix decomposition is static and needs to be determined only once by the encoder for the entire audio signal. On the other hand adaptive audio content is often characterized by continuously varying downmix matrices that may also be quite arbitrary, and the number of input channels/objects is generally larger, e.g., up to 16 in the Atmos version of Dolby TrueHD. Thus a static decomposition of the downmix matrix typically does not suffice to represent adaptive audio in a TrueHD format. Certain embodiments cover the decomposition of a given downmix matrix into primitive matrices as required by the TrueHD format.

Figure 2:
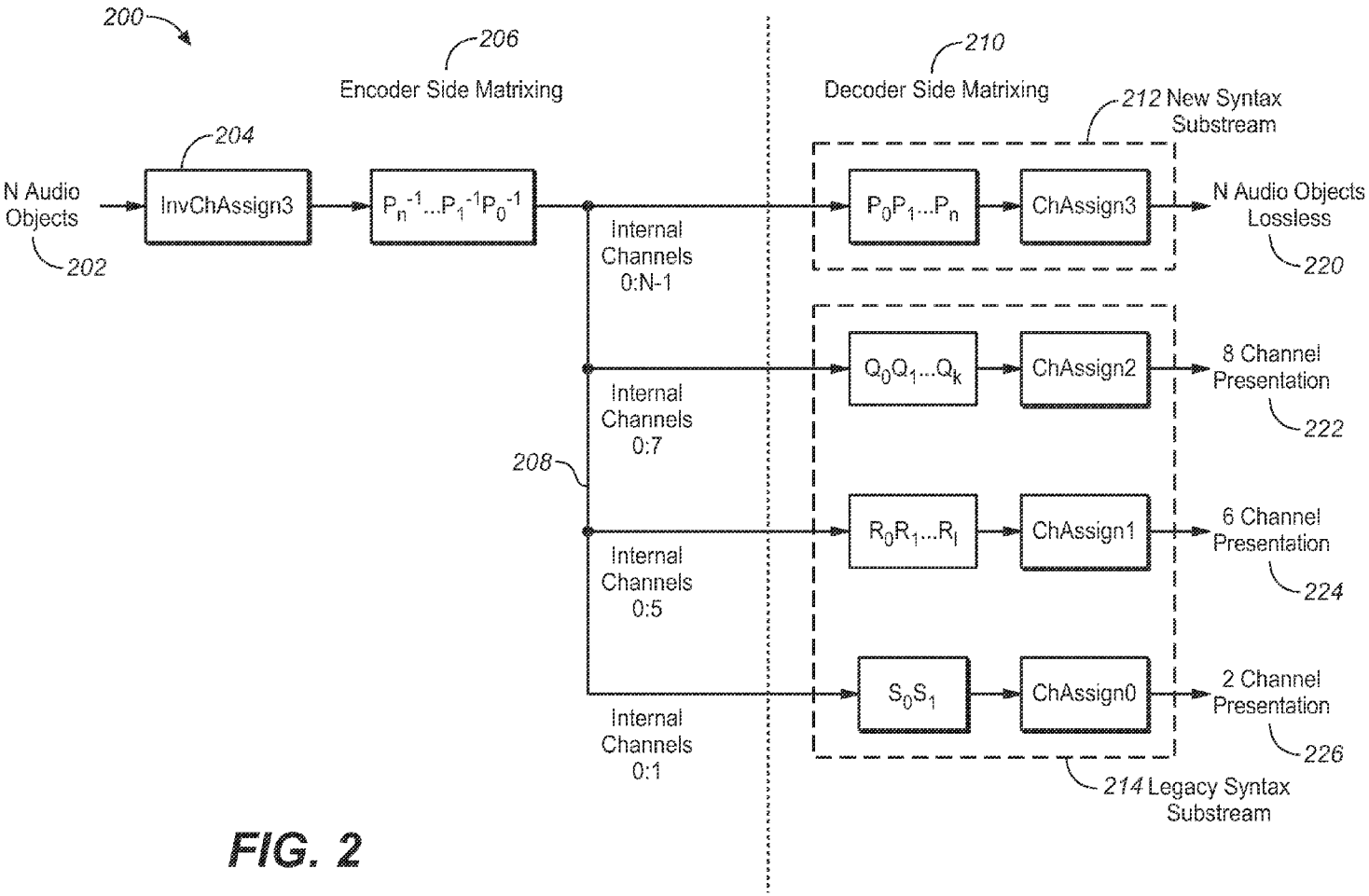
FIG. 2 illustrates a system that mixes N channels of adaptive audio content into a TrueHD bitstream, under some embodiments.

FIG. 2 illustrates a system that mixes N channels of adaptive audio content into a TrueHD bitstream, under some embodiments. FIG. 2 illustrates encoder-side 206 and decoder-side 210 matrixing of a TrueHD stream containing four substreams, three resulting in downmixes decodable by legacy decoders and one for reproducing the lossless original decodable by newer decoders.

In system 200, the N input audio objects 202 are subject to an encoder-side matrixing process 206 that includes an input channel assignment process 204 (invchassign3, inverse channel assignment 3) and input primitive matrices $P_n^{-1}, \ldots, P_1^{-1}, P_0^{-1}$. This generates internal channels 208 that are coded in the bitstream. The internal channels 208 are then input to a decoder side matrixing process 210 that includes substreams 212 and 214 that include output primitive matrices and output channel assignments (chAssign0-3) to produce the output channels 220-226 in each of the different downmix (or upmix) presentations.

As shown in system 200, a number N of audio objects 202 for adaptive audio content are matrixed 206 in the encoder to generate internal channels 208 in four substreams from which the following downmixes may be derived by legacy devices: (a) 8 ch (i.e., 7.1 ch) downmix 222 of the original content, (b) 6 ch (i.e., 5.1 ch) downmix 224 of (a), and (c) 2 ch downmix 226 of (b). For the example of FIG. 2, the 8 ch, 6 ch, and 2 ch presentations are required to be decoded by legacy devices, the output matrices $S_0$, $S_1$, $R_0, \ldots, R_1$, and $Q_0, \ldots, Q_k$ need to be in a format that can be decoded by legacy devices. Thus, the substreams 214 for these presentations are coded according to a legacy syntax. On the other hand the matrices $P_0, \ldots, P_n$ of substream 212 required to generate lossless reconstruction 220 of the input audio, and applied as their inverses in the encoder may be in a new format that may be decoded only by new TrueHD decoders. Also amongst the internal channels it may be required that the first eight channels that are used by legacy devices be encoded adhering to constraints of legacy devices, while the remaining N-8 internal channels may be encoded with more flexibility since they are only accessed by new decoders.

As shown in FIG. 2, substream 212 may be encoded in a new syntax for new decoders, while substreams 214 may be encoded in a legacy syntax for corresponding legacy decoders. As an example, for the legacy substream syntax, the primitive matrices may be constrained to have a maximum coefficient of 2, update in steps, i.e., cannot be interpolated, and matrix parameters, such as which channels the primitive matrices operate on may have to be sent every time the matrix coefficients update. The representation of internal channels may be through a 24-bit datapath. For the adaptive audio substream syntax (new syntax), the primitive matrices may be have a larger range of matrix coefficients (maximum coefficient of 128), continuous variation via specification of interpolation slope between updates, and syntax restructuring for efficient transmission of matrix parameters. The representation of internal channels may be through a 32-bit datapath. Other syntax definitions and parameters are also possible depending on the constraints and requirements of the system.

As described above, the matrix that transforms/downmixes a set of adaptive audio objects to a fixed speaker layout such as 7.1 (or other legacy surround format) is a dynamic matrix such as A(t) that continuously changes in time. However, legacy TrueHD generally only allows updating matrices at regular intervals in time. In the above example the output (decoder-side) matrices 210 $S_0$, $S_1$, $R_0, \ldots, R_1$, and $Q_0, \ldots, Q_k$ could possibly only be updated intermittently and cannot vary instantaneously. Further, it is desirable to not send matrix updates too often, since this side-information incurs significant additional data. It is instead preferable to interpolate between matrix updates to approximate a continuous path. There is no provision for this interpolation in some legacy formats (e.g., TrueHD), however, it can be accommodated in the bitstream syntax compatible with new TrueHD decoders. Thus, in FIG. 2, the matrices $P_0, \ldots, P_n$, and hence their inverses $P_0^{-1}, \ldots, P_n^{-1}$ applied at the encoder could be interpolated over time. The sequence of the interpolated input matrices 206 at the encoder and the non-interpolated output matrices 210 in the downmix sub streams would then achieve a continuously time-varying downmix specification A(t) or a close approximation thereof.

Figure 3:
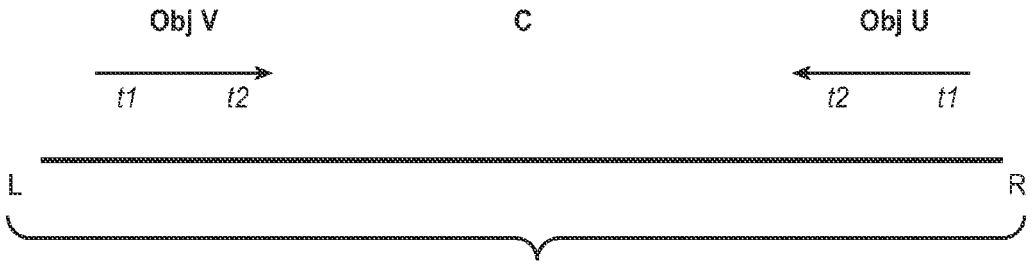
FIG. 3 is an example of dynamic objects for use in an interpolated matrixing scheme, under an embodiment.

FIG. 3 is an example of dynamic objects for use in an interpolated matrixing scheme, under an embodiment. FIG. 3 illustrates two objects Obj V and Obj U, and a bed C rendered to stereo (L, R). The two objects are dynamic and move from respective first locations at time t1 to respective second locations at time t2.

In general, an object channel of an object-based audio is indicative of a sequence of samples indicative of an audio object, and the program typically includes a sequence of spatial position metadata values indicative of object position or trajectory for each object channel. In typical embodiments of the invention, sequences of position metadata values corresponding to object channels of a program are used to determine an M×N matrix A(t) indicative of a time-varying gain specification for the program. Rendering N objects to M speakers at time t can be represented by multiplication of a vector x(t) of length "N", comprised of an audio sample at time t from each channel, by an M×N matrix A(t) determined from associated position metadata (and optionally other metadata corresponding to the audio content to be rendered, e.g., object gains) at time t. The resultant values (e.g., gains or levels) of the speaker feeds at time t can be represented as a vector y(t)=A(t)*x(t).

In an example of time-variant object processing, consider the system illustrated in FIG. 1 as having three adaptive audio objects as the three channel input audio. In this case, the two-channel downmix is required to be a legacy compatible downmix (i.e., stereo 2 ch). A downmix/rendering matrix for the objects of FIG. 3 may be expressed as:

$$A(t) = \begin{bmatrix} 0.707 & \sin(vt) & \cos(vt) \\ 0.707 & \cos(vt) & \sin(vt) \end{bmatrix}$$

In this matrix, the first column may correspond to the gains of the bed channel (e.g., center channel, C) that feeds equally into the L and R channels. The second and third columns then correspond to the U and V object channels. The first row corresponds to the L channel of the 2 ch downmix and the second row corresponds to the R channel, and the objects are moving towards each other at a speed, as shown in FIG. 3. At time t1 the adaptive audio to 2 ch downmix specification may be given by:

$$A(t1) = \begin{bmatrix} 0.707 & 0.2903 & 0.9569 \\ 0.707 & 0.9569 & 0.2902 \end{bmatrix}$$

For this specification by choosing input primitive matrices as described above for the decomposition 1 method, the output matrices of the two channel substream can be identity matrices. As the objects move around, from t1 to t2 (e.g., 15 access units later or 15*T samples, where T is the length of an access unit) the adaptive audio to 2 ch specification evolves into:

$$A(t2) = \begin{bmatrix} 0.707 & 0.5556 & 0.8315 \\ 0.707 & 0.8315 & 0.5556 \end{bmatrix}$$

In this case, the input primitive matrices are given as:

$$\begin{bmatrix} 0.707 & 0.5556 & 0.8315 \\ 0.707 & 0.8315 & 0.5556 \\ 1 & -0.628 & 7.717 \end{bmatrix} = \underbrace{\begin{bmatrix} 1 & 0 & 0 \\ 1.2759 & 1 & -0.1950 \\ 0 & 0 & 1 \end{bmatrix}}_{Pnew_0^{-1}}$$

-continued $$\underbrace{\begin{bmatrix} 1 & -4.624 & 0.707 \\ 0 & 1 & 0 \\ 0 & 0 & 1 \end{bmatrix}}_{Pnew_1^{-1}} \underbrace{\begin{bmatrix} 1 & 0 & 0 \\ 0 & 1 & 0 \\ -0.628 & 7.717 & 1 \end{bmatrix}}_{Pnew_2^{-1}} \underbrace{\begin{bmatrix} 0 & 1 & 0 \\ 0 & 0 & 1 \\ 1 & 0 & 0 \end{bmatrix}}_{D_3}$$

So that the first two rows of the sequence are the required specification. The system can thus continue using identity output matrices in the two-channel substream even at time t2. Additionally note that the pairs of unit primitive matrices ($P_0$, $Pnew_0$), ($P_1$, $Pnew_1$), and ($P_2$, $Pnew_2$) operate on the same channels, i.e., they have the same rows to be non-trivial. Thus one could compute the difference or delta between these primitive matrices as the rate of change per access unit of the primitive matrices in the lossless substream as:

$$\Delta_0 = \frac{Pnew_0 - P_0}{15} = \begin{bmatrix} 0 & 0 & 0 \\ 0.0261 & 0 & -0.0184 \\ 0 & 0 & 0 \end{bmatrix}$$

$$\Delta_1 = \frac{Pnew_1 - P_1}{15} = \begin{bmatrix} 0 & 0.1416 & 0 \\ 0 & 0 & 0 \\ 0 & 0 & 0 \end{bmatrix}$$

$$\Delta_2 = \frac{Pnew_2 - P_2}{15} = \begin{bmatrix} 0 & 0 & 0 \\ 0 & 0 & 0 \\ -0.0250 & -0.01885 & 0 \end{bmatrix}$$

An audio program rendering system (e.g., a decoder implementing such a system) may receive metadata which determine rendering matrices A(t) (or it may receive the matrices themselves) only intermittently and not at every instant t during a program. For example, this could be due to any of a variety of reasons, e.g., low time resolution of the system that actually outputs the metadata or the need to limit the bit rate of transmission of the program. It is therefore desirable for a rendering system to interpolate between rendering matrices A(t1) and A(t2) at time instants t1 and t2, respectively, to obtain a rendering matrix A(t3) for an intermediate time instant t3. Interpolation generally ensures that the perceived position of objects in the rendered speaker feeds varies smoothly over time, and may eliminate undesirable artifacts that stem from discontinuous (piece-wise constant) matrix updates. The interpolation may be linear (or nonlinear), and typically should ensure a continuous path from A(t1) to A(t2).

In an embodiment, the primitive matrices applied by the encoder at any intermediate time-instant between t1 and t2 are derived by interpolation. Since the output matrices of the downmix substream are held constant, as identity matrices, the achieved downmix equations at a given time t in between t1 and t2 can be derived as the first two rows of the product:

$$\left(P_0^{-1} - \Delta_0 * \frac{t - t1}{T}\right)\left(P_1^{-1} - \Delta_1 * \frac{t - t1}{T}\right)\left(P_2^{-1}(t1) - \Delta_2 * \frac{t - t1}{T}\right)D_3$$

Thus a time-varying specification is achieved while not interpolating the output matrices of the two-channel substream but only interpolating the primitive matrices of the lossless substream that corresponds to the adaptive audio presentation. This is achieved because the specifications A(t1) and A(t2) were decomposed into a set of input primitive matrices that when multiplied contained the required specification as a subset of the rows, and hence allowed the output matrices of the downmix substreams to be constant identity matrices.

In an embodiment, the matrix decomposition method includes an algorithm to decompose an M*N matrix (such as the 2*3 specification A(t1) or A(t2)) into a sequence of N*N primitive matrices (such as the 3*3 primitive matrices $P_0^{-1}$, $P_1^{-1}$, $P_2^{-1}$, or $Pnew_0^{-1}$, $Pnew_1^{-1}$, $Pnew_2^{-1}$ in the above example) and a channel assignment (such as $d_3$) such that the product of the sequence of the channel assignment and the primitive matrices contains in it M rows that are substantially close to or exactly the same as the specified matrix. In general, this decomposition algorithm allows the output matrices to be held constant. However, it forms a valid decomposition strategy even if that were not the case.

In an embodiment, the matrix decomposition scheme involves a matrix rotation mechanism. As an example, consider the 2*2 matrix Z which will be referred to as a "rotation":

$$Z = \begin{bmatrix} -0.4424 & -0.4424 \\ -1.0607 & 1.0607 \end{bmatrix}$$

The system constructs two new specifications B(t1) and B(t2) by applying the rotation Z on A(t1) and A(t2):

$$B(t1) = Z * A(t1) = \begin{bmatrix} -0.6255 & -0.5517 & -0.5517 \\ 0 & 0.7071 & -0.7071 \end{bmatrix}$$

The 12-norm (root square sum of elements) of the rows of B(t1) is unity, and the dot product of the two rows is zero. Thus, if one designs input primitive matrices and channel assignment to achieve the specification B(t1) exactly, then application of the so designed primitive matrices and channel assignments to the input audio channels (ch0, ch1, ch2) will result in two internal channels (ch0', ch1') that are not too large, i.e., the power is bounded. Further, the two internal channels (ch0', ch1') are likely to be largely uncorrelated, if the input channels were largely uncorrelated to begin with, which is typically the case with object audio. This results in improved compression of the internal channels into the bitstream. Similarly:

$$B(t2) = Z * A(t2) = \begin{bmatrix} -0.6255 & -0.6136 & -0.6136 \\ 0 & 0.2927 & -0.2926 \end{bmatrix}$$

In this case the rows are orthogonal to each other, however the rows are not of unit norm. Again the input primitive matrices and channel assignment can be designed using an embodiment described above in which an M*N matrix is decomposed into a sequence of N*N primitive matrices and a channel assignment to generate primitive matrices containing M rows that are exactly or nearly exactly the specified matrix.

However, it is desired that the achieved downmix correspond to the specification A(t1) at time t1 and A(t2) at time t2. Thus, deriving the two-channel downmix from the two internal channels (ch0', ch1') requires a multiplication by $Z^{-1}$. This could be achieved by designing the output matrices as follows:

$$Z^{-1} = \begin{bmatrix} -1.1303 & -0.4714 \\ -1.1303 & 0.4714 \end{bmatrix} = \underbrace{\begin{bmatrix} -0.8847 & -0.4170 \\ 0 & 1 \end{bmatrix}}_{Q_1} \underbrace{\begin{bmatrix} 1 & 0 \\ -1.0607 & 1.0607 \end{bmatrix}}_{Q_0}$$

Since the same rotation Z was applied at both instants of time, the same output matrices $Q_0$, $Q_1$ can be applied by the decoder to the internal channels at times t1 and t2 to get the required specifications A(t1) and A(t2), respectively. So, the output matrices have been held constant (although they are not identity matrices any more), and there is an added advantage of improved compression and internal channel limiting in comparison with other embodiments.

As a further example, consider a sequence of downmixes as required in the four substream example of FIG. 2. Let the 7.1 ch to 5.1 ch downmix matrix be as follows:

$$A_1 = \begin{bmatrix} 1 & 0 & 0 & 0 & 0 & 0 & 0 & 0 \\ 0 & 1 & 0 & 0 & 0 & 0 & 0 & 0 \\ 0 & 0 & 1 & 0 & 0 & 0 & 0 & 0 \\ 0 & 0 & 0 & 1 & 0 & 0 & 0 & 0 \\ 0 & 0 & 0 & 0 & 0.707 & 0 & 0.707 & 0 \\ 0 & 0 & 0 & 0 & 0 & 0.707 & 0 & 0.707 \end{bmatrix}$$

and the 5.1 ch to 2 ch downmix matrix be the well-known matrix:

$$A_2 = \begin{bmatrix} 1 & 0 & 0.707 & 0 & 0.707 & 0 \\ 0 & 1 & 0.707 & 0 & 0 & 0.707 \end{bmatrix}$$

In this case, a rotation Z to be applied to A(t), the time-varying adaptive audio-to-8 ch downmix matrix, can be defined as:

$$Z = \begin{bmatrix} 1 & 0 & 0.707 & 0 & 0.5 & 0 & 0.5 & 0 \\ 0 & 1 & 0.707 & 0 & 0 & 0.5 & 0 & 0.5 \\ 0 & 0 & 1 & 0 & 0 & 0 & 0 & 0 \\ 0 & 0 & 0 & 1 & 0 & 0 & 0 & 0 \\ 0 & 0 & 0 & 0 & 0.707 & 0 & 0.707 & 0 \\ 0 & 0 & 0 & 0 & 0 & 0.707 & 0 & 0.707 \\ 0 & 0 & 0 & 0 & 0 & 0 & 1 & 0 \\ 0 & 0 & 0 & 0 & 0 & 0 & 0 & 1 \end{bmatrix}$$

The first two rows of Z form the sequence of $A_2$ and $A_1$. The next four rows form the last four rows of $A_1$. The last two rows have been picked as identity rows since they make Z full rank and invertible.

It can be shown that whenever Z*A(t) is full rank [1] (rank=8), if the input primitive matrices and channel assignment are designed using the first aspect of the invention so that Z*A(t) is contained in the first 8 rows of the decomposition, then:

(a) The first two internal channels form exactly the two channel presentation and the output matrices $S_0$, $S_1$ for substream 0 in FIG. 2 are simply identity matrices and hence constant over time (b) Further the six channel downmix can be obtained by applying constant (but not identity) output matrices $R_0, \ldots, R_l$.

(c) The eight channel downmix can be obtained by applying constant (but not identity) output matrices $Q_0, \ldots, Q_k$.

Thus, when employing such an embodiment to design input primitive matrices, the rotation Z helps to achieve the hierarchical structure of TrueHD. In certain cases, it may be desired to support a sequence of K downmixes specified by a sequence of downmix matrices (going from top to bottom) $A_0$ of dimension $M_0 \times N$, $A_1$ of dimension $M_1 \times M_0, \ldots, A_k$ of dimension $M_k \times M_{k-1}, \ldots k<K$. In other words, the system is able to support the following hierarchy of linear transformations of the input audio in a single TrueHD bitstream: $A_0$, $A_1 \times A_0, \ldots, A_k \times \ldots A_1 \times A_0$, $k<K$, where $A_0$ is the topmost downmix that is of dimension $M_0 \times N$.

In an embodiment, the matrix decomposition method includes an algorithm to design an $L \times M_0$ rotation matrix Z that is to be applied to the top-most downmix specification $A_0$ so that: (1) The $M_k$ channel downmix (for $\{0, 1, \ldots, K-1\}$) can be obtained by a linear combination of the smaller of $M_k$ or L rows of the $L \times N$ rotated specification $Z^*A_0$, and one or more of the following may additionally be achieved: rows of the rotated specification have low correlation; rows of the rotated specification have small norms/limits the power of internal channels; the rotated specification on decomposition into primitive matrices results in small coefficient/coefficients that can be represented within the constraints of the TrueHD bitstream syntax; the rotated specification enables a decomposition into input primitive matrices and output primitive matrices such that the overall error between the required specification and achieved specification (the sequence of the designed matrices) is small; and the same rotation when applied to consecutive matrix specifications in time, may lead to small differences between primitive matrices at the different time instants.

Figure 4:
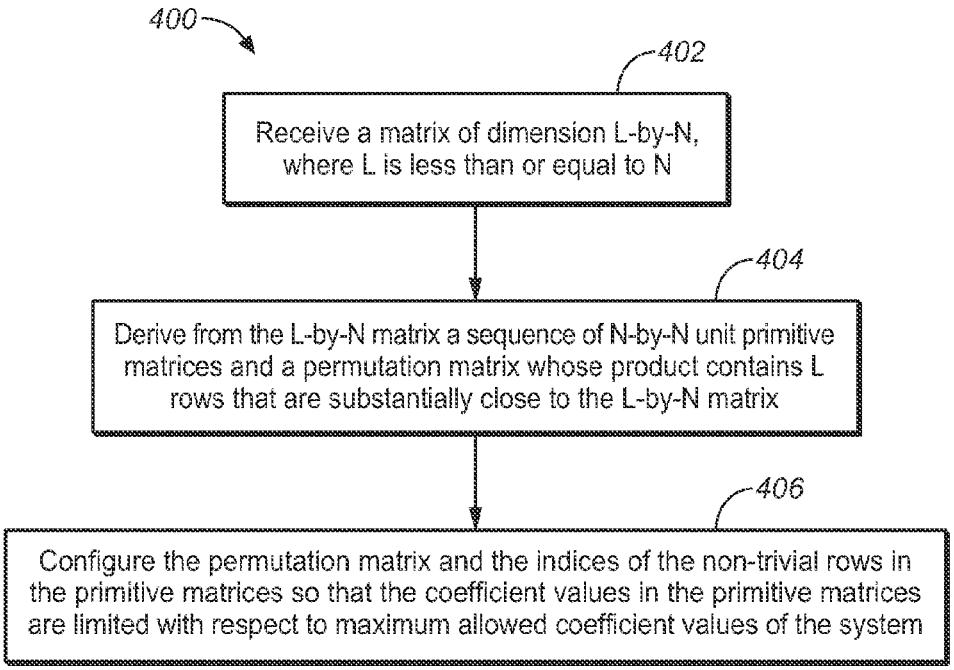
FIG. 4 is a flowchart illustrating a method of decomposing a multi-dimensional matrix into a sequence of unit primitive matrices and a permutation matrix, under an embodiment.

In general, an embodiment is directed to a method of decomposing a multi-dimensional matrix into a sequence of unit primitive matrices and a permutation matrix, as shown in the flowchart of FIG. 4. Process 400 begins with an audio processing system comprising an encoder and decoder receiving a matrix of dimension L-by-N, where L is less than or equal to N, 402. Next, the system derives from the L-by-N matrix a sequence of N-by-N unit primitive matrices and a permutation matrix, wherein the product of the primitive matrices and the permutation matrix contains L rows that are substantially close to the L-by-N matrix, 404. The permutation matrix and the indices of the non-trivial rows in the primitive matrices are configured such that the absolute coefficient values in the primitive matrices are limited with respect to a maximum allowed coefficient value of the signal processing system, 406. Such a maximum allowed coefficient value may be determined by a value limit of a bitstream transmitting data from the encoder to the decoder, or to some other processing limit of the system. The matrix decomposition process is intended to operate on matrices containing any type of data and for any type of application. Certain embodiments described herein apply the matrix decomposition process to audio signal data rendered through discrete channel outputs, but embodiments are not so limited.

Implementing Algorithms

One or more embodiments are implemented through one or more algorithms executed on a processor-based computer. A first algorithm or set of algorithms may implement the decomposition of an M*N matrix into a sequence of N*N primitive matrices and a channel assignment, also referred to as the first aspect of the matrix decomposition method, and a second algorithm or set of algorithms may implement designing a rotation matrix Z that is to be applied to the topmost downmix specification in a sequence of downmixes specified by a sequence of downmix matrices, also referred to as the second aspect of the matrix decomposition method.

For the below-described algorithm(s), the following preliminaries and notation are provided. For any number x we define:

$$\mathrm{abs}(x) = \begin{cases} x & x \geq 0 \\ -x & x < 0 \end{cases}$$

For any vector $x=[x_0 \ldots x_m]$ we define:

$$\mathrm{abs}(x) = [\,\mathrm{abs}(x_0) \;\ldots\; \mathrm{abs}(x_m)\,]$$

$$\mathrm{sum}(x) = \sum_{i=0}^{m} x_i$$

For any $M \times N$ matrix X, the rows of X are indexed top-to-bottom as 0 to M−1, and the columns left-to-right as 0 to N−1, and denote by $x_{ij}$ the element of X in row i and column j.

$$X = \begin{bmatrix} x_{00} & x_{01} & \cdots & \cdots & x_{0N-1} \\ x_{10} & x_{11} & \cdots & \cdots & x_{1N-1} \\ \vdots & \vdots & \vdots & & \vdots \\ \vdots & \vdots & \vdots & & \vdots \\ x_{M-10} & x_{M-11} & & & x_{M-1N-1} \end{bmatrix}$$

The transpose of X is indicated as $X^T$. Let $u=[u_0\ u_1 \ldots u_{l-1}]$ be a vector of l indices picked from 0 to M−1, and $v=[v_0 \ldots v_{k-1}]$ be a vector of k indices picked from 0 to N−1. X(u, v) denotes the $l \times k$ matrix Y whose element $y_{ij}=x_{u_i v_j}$, i.e., Y or X(u, v) is the matrix formed by selecting from X rows with indices given by u and columns with indices given by v.

If M=N, the determinant [1] of X can be calculated and is denoted as det(X). The rank of the matrix X is denoted as rank(X), and is less than or equal to the smaller of M and N. Given a vector x of N elements and a channel index c, a primitive matrix P that manipulates channel c is constructed by prim(x,c) that replaces row c of an $N \times N$ identity matrix with x.

In an embodiment, an algorithm (Algorithm 1) for the first aspect is provided as follows: Let A be an $M \times N$ matrix with $M<=N$ and let rank(A)=M, i.e., A is full rank. The algorithm determines unit primitive matrices $P_0, P_1, \ldots, P_n$ of dimension $N \times N$ and a channel assignment $d_N$ so that the product: $P_n \times \ldots \times P_1 \times P_0 \times D_N$, where $D_N$ is the permutation matrix corresponding to $d_N$, contains in it M rows matching the rows of A.

(A) Initialize: $f=[0\ 0 \ldots 0]_{1 \times M}$, $e=\{0, 1, \ldots, N-1\}$, B=A, $\underline{P}=\{\ \}$ (B) Determine Unit Primitive Matrices:

while (sum(f)<M){

(1) r=[ ], c=[ ], t=0;

(2) Determine rowsToLoopOver (3) Determine row group r and corresponding columns/channels c:

```
for ( r in rowsToLoopOver )
{
  (a)  c_best = max_{c∈e,c∉c} abs( det (B([r  r],[c  c])))

  (b)  if abs( det (B([r  r],[c  c_best]))) >0
  {
    (i)  if r is an empty vector and abs( det (B([r  r],[c  c_best ]))) ==1 ,
         t =1
    (ii) f_r =1, ( f_r is element r in f )
    (iii) r = [r  r],c = [c  c_best]
  }
  (c) if t =1 break;
}
```

(4) Determine unit primitive matrices for row group:
(a) if t=1, $P'_0$=prim(B(r,[0 . . . N−1])), $\underline{P}'=\{P'_0\}$;
(b) else

```
  {
    (i) Select one more column/channel c_last ∈ e, c_last ∉ c and append:
        c = [c  c_last]
    (ii) Decompose row group r in B given column selection c via the
         Algorithm 2 below to get a set of unit primitive matrices P'
  }
```

(5) Add new unit primitive matrices to existing set: $\underline{P}=\{\underline{P}';\underline{P}\}$
(6) Account for primitive matrices: $B=A\times P_0^{-1}\times P_1^{-1}: \ldots \times P_1^{-1}$ where $\underline{P}$ is the sequence $\underline{P}=\{P_l \ldots ; P_0\}$
(7) If t=0, c=[$c_1$ . . . ].
(8) Remove the elements in c from e
}
(C) Determine Channel Assignment:
(1) Set $B=P_n: \ldots \times P_1\times P_0$, where $\underline{P}$ is the sequence $\underline{P}=\{P_n \ldots ;P_0\}$.
(2) e={0, 1, . . . , N−1}, $c_N$=[ ]
(3) For (r in 0, . . . M−1)

```
  {
    (i) Identify row r' in B that is same as/very close to row r in A
    (ii) c_N = [c_N  r']
    (iii) Remove r' from e
  }
```

(4) Append elements of e to $c_N$ in order to make the latter a vector of N elements. Determine the permutation $d_N$ that is the inverse of $C_N$, and the corresponding permutation matrix $D_N$.
(5) Account for channel assignment: $P_i=D_N\times P_i\times D_N^{-1}$, $P_i\in\underline{P}$ In an embodiment, an algorithm (denoted Algorithm 2) is provided as shown below. This algorithm continues from step B.4.b.ii in Algorithm 1. Given matrix B, row selection r and column selection C:

(A) Complete c to be a vector of N elements by appending to it elements in {0, 1, . . . , N−1} not already in it.
(B) Set $$G=\begin{bmatrix} 1 & 0 & \ldots & 0 \\ & B(r,c) & & \end{bmatrix}$$

(C) Find l+1 unit primitive matrices $P'_0, P'_1, \ldots, P'_l$ where l is the length of r and row i of $P'_i$ is the non-trivial row of the primitive matrix, such that rows 1 to l of the sequence $P'_l\times \ldots \times P'_1\times P'_0$ match rows 1 to l of G. This is a constructive procedure, which is shown for an example matrix below
(D) Construct permutation matrix $C_N$ corresponding to c and set $P'_i=C_N^{-1}\times P'_i\times C_N$
(E) $\underline{P}'=\{P'_l \ldots ; P'_1; P'_0\}$;

An example for step (c) in algorithm 2 is given as follows: Say, $$G=\begin{pmatrix} 1 & 0 & 0 \\ g_{1,0} & g_{1,1} & g_{1,2} \\ g_{2,0} & g_{2,1} & g_{2,2} \end{pmatrix}.$$

Here, l=2. We want to decompose this into three primitive matrices:

$$P_2=\begin{pmatrix} 1 & 0 & 0 \\ 0 & 1 & 0 \\ p_{2,0} & p_{2,1} & 1 \end{pmatrix}, P_1=\begin{pmatrix} 1 & 0 & 0 \\ p_{1,0} & 1 & p_{1,2} \\ 0 & 0 & 1 \end{pmatrix}, P_0=\begin{pmatrix} 1 & p_{0,1} & p_{0,2} \\ 0 & 1 & 0 \\ 0 & 0 & 1 \end{pmatrix}$$

Such that:

$$P_2P_1P_0=\begin{pmatrix} 1 & p_{0,1} & p_{0,2} \\ g_{1,0} & g_{1,1} & g_{1,2} \\ g_{2,0} & g_{2,1} & g_{2,2} \end{pmatrix}$$

Since multiplication pre-multiplication by $P_2$ only affects the third row, $$\begin{pmatrix} 1 & 0 & 0 \\ p_{1,0} & 1 & p_{1,2} \\ 0 & 0 & 1 \end{pmatrix}\begin{pmatrix} 1 & p_{0,1} & p_{0,2} \\ 0 & 1 & 0 \\ 0 & 0 & 1 \end{pmatrix}=\begin{pmatrix} 1 & p_{0,1} & p_{0,2} \\ g_{1,0} & g_{1,1} & g_{1,2} \\ 0 & 0 & 1 \end{pmatrix}$$

Which requires that $p_{1,0}=g_{1,0}$ and $p_{0,1}=g_{1,1}-1/g_{1,0}$ as above. $p_{0,2}$ is not yet constrained, whatever value it takes can be compensated for by altering $p_{1,2}=g_{1,2}-p_{1,0}p_{0,2}$.

For the row 2 primitive matrix, our starting point is that we require $$P_2P_1P_0=\begin{pmatrix} 1 & 0 & 0 \\ 0 & 1 & 0 \\ p_{2,0} & p_{2,1} & 1 \end{pmatrix}\begin{pmatrix} 1 & p_{0,1} & p_{0,2} \\ g_{1,0} & g_{1,1} & g_{1,2} \\ 0 & 0 & 1 \end{pmatrix}=\begin{pmatrix} 1 & p_{0,1} & p_{0,2} \\ g_{1,0} & g_{1,1} & g_{1,2} \\ g_{2,0} & g_{2,1} & g_{2,2} \end{pmatrix}$$

Looking at $p_{2,0}$ & $p_{2,1}$ we have the simultaneous equations $$\begin{pmatrix} p_{2,0} & p_{2,1} \end{pmatrix}\begin{pmatrix} 1 & p_{0,1} \\ g_{1,0} & g_{1,1} \end{pmatrix}=\begin{pmatrix} g_{2,0} & g_{2,1} \end{pmatrix}$$

Now we know this is soluble because $$\begin{vmatrix} 1 & p_{0,1} \\ g_{1,0} & g_{1,1} \end{vmatrix}=|P_1P_0|=1.$$

And now $p_{0,2}$ is defined by $$g_{2,2}=p_{2,0}p_{0,2}+p_{2,1}g_{1,2}+1$$

Which will exist so long as $p_{2,0}$ doesn't vanish.

With regard to Algorithm 1, in practical application there is a maximum coefficient value that can be represented in the TrueHD bitstream and it is necessary to ensure that the absolute value of coefficients are smaller than this threshold. The primary purpose of finding the best channel/column in step B.3.a of Algorithm 1 is to ensure that the coefficients in the primitive matrices are not large. In another variation of Algorithm 1, rather than compare the determinant in Step B.3.b to 0, one may compare it to a positive non-zero threshold to ensure that the coefficients will be explicitly constrained according to the bitstream syntax. In general smaller the determinant computed in Step B.3.b larger the eventual primitive matrix coefficients, so lower bounding the determinant, upper bounds the absolute value of the coefficients.

In step B.2 the order of rows handled in the loop of step B.3 given by rowsToLoopOver is determined. This could simply be the rows that have not yet been achieved as indicated by the flag vector f ordered in ascending order of indices. In another variation of Algorithm 1, this could be the rows ordered in ascending order of the overall number of times they have been tried in the loop of step B.3, so that the ones that have been tried least will receive preference.

In step B.4.b.i of Algorithm 1 an additional column $c_{last}$ is to be chosen. This could be arbitrarily chosen, while adhering to the constraint that $c_{last}\epsilon e$, $c_{last}\notin C$. Alternatively, one may consciously choose $c_{last}$ so as to not use up a column that may be most beneficial for decomposition of rows in a subsequent iteration. This could be done by tracking the costs for using different columns as computed in Step. B.3.a of Algorithm 1.

Note that Step. B.3 of Algorithm 1 determines the best column for one row and moves on to the next row. In another variation of Algorithm 1, one may replace Step B.2 and Step B.3 with a nested pair of loops running over both rows yet to be achieved and columns still available so that an optimal (minimizing the value of primitive matrix coefficients) ordering of both rows and columns can be determined simultaneously.

While Algorithm 1 was described in the context of a full rank matrix whose rank is M, it can be modified to work with a rank deficient matrix whose rank is L<M. Since the product of unit primitive matrices is always full rank, we can expect only to achieve L rows of A in that case. An appropriate exit condition will be required in the loop of Step B to ensure that once L linearly independent rows of A are achieved the algorithm exits. The same work-around will also be applicable if M>N.

The matrix received by Algorithm 1 may be a downmix specification that has been rotated by a suitably designed matrix Z. It is possible that during the execution of Algorithm 1 one may end up in a situation where the primitive matrix coefficients may grow larger than what can be represented in the TrueHD bitstream, which fact may not have been anticipated in the design of Z. In yet another variation of Algorithm 1 the rotation Z may be modified on the fly to ensure that the primitive matrices determined for the original downmix specification rotated by the modified Z behaves better as far as values of primitive matrix coefficients are concerned. This can be achieved by looking at the determinant calculated in Step B3.b of Algorithm 1 and amplifying row r by suitable modification of Z, so that the determinant is larger than a suitable lower bound.

In Step C.4 of the algorithm one may arbitrarily choose elements in e to complete $C_N$ into a vector of N elements. In a variation of Algorithm 1 one may carefully choose this ordering so that the eventual (after Step C.5) sequence of primitive matrices and channel assignment $P_n\times \ldots \times P_1\times P_0\times D_N$ has rows with larger norms/large coefficients positioned towards the bottom of the matrix. This makes it more likely that on applying the sequence $P_n\times \ldots \times P_1\times P_0\times D_N$ to the input channels, larger internal channels are positioned at higher channel indices and hence encoded into higher substreams. Legacy TrueHD supports only a 24-bit datapath for internal channels while new TrueHD decoders support a larger 32-bit datapath. So pushing larger channels to higher substreams decodable only by new TrueHD decoders is desirable.

With regard to Algorithm 1, in practical application, suppose the application needs to support a sequence of K downmixes specified by a sequence of downmix matrices (going from top-to-bottom) as follows: $A_0\rightarrow \ldots \rightarrow \ldots \rightarrow A_{K-1}$, where $A_0$ has dimension $M_0\times N$, and $A_k$, k>0 has dimension $M_k\times M_{k-1}$. For instance, there may be given: (a) a time-varying 8×N specification $A_0=A(t)$ that downmixes N adaptive audio channels to 8 speaker positions of a 7.1 ch layout, (b) a 6×8 static matrix $A_1$ that specifies a further downmix of the 7.1 ch mix to a 5.1 ch mix, or (c) a 2×6 static matrix $A_2$ that specifies a further downmix of the 5.1 ch mix to a stereo mix. The method describes the design of an $L\times M_0$ rotation matrix Z that is to be applied to the top-most downmix specification $A_0$, before subjecting it to Algorithm 1 or a variation thereof.

In a first design (denoted Design 1), if the downmix specifications $A_k$,k>0, have rank $M_k$ then we can choose $L=M_0$ and Z may be constructed according to the following algorithm (denoted Algorithm 3):

(A) Initialize: L=0, Z=[ ], c=[0 1 . . . N−1]

(B) Construct:

for ( k = K −1 to 0)
{
(a) If k > 0 calculate the sequence for the $M_k$ channel downmix from the first downmix: $H_k = A_k \times A_{k-1} \times \ldots \times A_1$
(b) Else set $H_k$ to an identity matrix of dimension $M_k$
(c) Update Z: $r = [L \quad L+1 \quad \ldots \quad M_k - 1]$, $Z = \begin{bmatrix} Z \\ H_k(r,c) \end{bmatrix}$
(d) Update $L = M_k$
}

This design will ensure that the $M_k$ channel downmix (for $k\epsilon\{0, \ldots, K-1\}$) can be obtained by a linear combination of the smaller of $M_k$ or L rows of the L×N rotated specification $Z*A_0$. This algorithm was employed to design the rotation of an example case described above. The algorithm returns a rotation that is the identity matrix if the number of downmixes K is one.

A second design (denoted Design 2) may be used that employs the well-known singular value decomposition (SVD). Any M×N matrix X can be decomposed via SVD as X=U×S×V where U and V are orthonormal matrices of dimension M×M and N×N, respectively, and S is an M×N diagonal matrix. The diagonal matrix S is defined thus:

$$S = \begin{bmatrix} s_{00} & 0 & 0 & \dots & 0 & 0 \\ 0 & s_{11} & \vdots & & \vdots & 0 \\ 0 & \dots & \vdots & \vdots & \vdots & \vdots \\ \vdots & \dots & & s_{ii} & \dots & \vdots \\ 0 & 0 & 0 & \dots & \dots & \end{bmatrix}$$

In this matrix, the number of elements on the diagonal is the smaller of M or N. The values $s_i$ on the diagonal are non-negative and are referred to as the singular values of X. It is further assumed that the elements on the diagonal have been arranged in decreasing order of magnitude, i.e., $s_{00} \geq s_{11} \geq \dots$. Unlike in Design 1, the downmix specifications can be of arbitrary rank in this design. The matrix Z may be constructed according to the following algorithm (denoted Algorithm 4) as follows:

(A) Initialize: L=0, z=[ ], X=[ ], c=[0 1 . . . N−1]

(B) Construct:

for ( k = K −1 to 0)
{
(a) If k > 0 calculate the sequence for the $M_k$ channel downmix from the first downmix: $H_k = A_k \times A_{k-1} \times \dots \times A_1$
(b) Else set $H_k$ to an identity matrix of dimension $M_k$
(c) Calculate the sequence for the $M_k$ channel downmix from the input: $T_k = H_k \times A_0$
(d) If the basis set X is not empty:
{
(i) Calculate projection coefficients: $W_k = T_k \times X^T$
(ii) Compute matrix to decompose with prediction: $T_k = T_k - W_k \times X$
(iii) Account for prediction in rotation: $H_k = H_k - W_k \times Z$
}
(e) Decompose via SVD $T_k = USV$
(f) Find the largest i in {0, 1,..., min($M_k$ - 1, N-1)} such that $s_{ii} > \theta$, where θ is a small positive threshold (say, 1/1024) used to define the rank of a matrix.
(g) Build the basis set: $X = \begin{bmatrix} X \\ V([0 \quad 1 \quad \dots \quad i], c) \end{bmatrix}$
(h) Get new rows for Z:

$$Z' = \begin{bmatrix} \frac{1}{s_{00}} & 0 & \dots & 0 \\ 0 & \frac{1}{s_{11}} & \vdots & \vdots \\ \vdots & \vdots & \vdots & 0 \\ 0 & \dots & 0 & \frac{1}{s_{ii}} \end{bmatrix} \times U^T([0 \quad \dots \quad i],[0 \quad \dots \quad M_k]) \times H_k$$

(i) Update $Z = \begin{bmatrix} Z \\ Z' \end{bmatrix}$
}
(C) L = number of rows in Z Note that the eventual rotated specification $Z^*A_0$ is substantially the same as the basis set X being built in Step. B.g of Algorithm 4. Since the rows of X are rows of an orthonormal matrix, the rotated matrix $Z^*A_0$ that is processed via Algorithm 1 will have rows of unit norm, and hence the internal channels produced by the application of primitive matrices so obtained will be bounded in power.

In an example above, Algorithm 4 was employed to find the rotation Z in an example above. In that case there was a single downmix specification, i.e., K=1, $M_0$=2, N=3, and the $M_0 \times N$ specification was A(t1).

For a third design (Design 3), one could additionally multiply Z obtained via Design 1 or Design 2 above with a diagonal matrix W containing non-zero gains on the diagonal $$Z'' = \underbrace{\begin{bmatrix} w_0 & 0 & \dots & 0 \\ 0 & w_1 & \ddots & \vdots \\ \vdots & \ddots & \ddots & 0 \\ 0 & \dots & 0 & w_{L-1} \end{bmatrix}_{L \times L}}_{W} \times Z, \; w_0 > 0$$

The gains may be calculated so that $Z''^*A_0$ when decomposed via Algorithm 1 or one of its variants results in primitive matrices with coefficients that are small can be represented in the TrueHD syntax. For instance, one could examine the rows of $A' = Z^*A_0$ and set:

$$w_i = \frac{1}{\text{maxabs}(A'(i, [0 \quad 1 \quad \dots \quad N-1]))},$$

This would ensure that the maximum element in every row of the rotated matrix $Z''^*A_0$ has an absolute value of unity, making the determinant computed in Step B.3.b of Algorithm 1 less likely to be close to zero. In another variation the gains $w_i$ are upper bounded, so that very large gains (which may occur when A' is approaching rank deficiency) are not allowed.

A further modification of this approach is to start off with $w_i$=1, and increase it (or even decrease it) as Algorithm 1 runs to ensure that the determinant in Step B.3.b of Algorithm 1 has a reasonable value, which in turn will result in smaller coefficients when the primitive matrices are determined in Step. B.4 of Algorithm 1.

In an embodiment, the method may implement a rotation design to hold output matrices constant. In this case, consider the example of FIG. 2, in which the adaptive audio to 7.1 ch specification is time-varying, while the specifications to downmix further are static. As discussed above, it may be beneficial to be able to maintain output primitive matrices of downmix substreams constant, since they may conform to the legacy TrueHD syntax. This can in turn be achieved by maintaining the rotation Z a constant. Since the specifications $A_1$ and $A_2$ are static, irrespective of what the adaptive audio-to-7.1 ch specification A(t) is, Design 1/Algorithm 3 above will return the same rotation Z. However, as Algorithm 1 progresses with its decomposition of Z*A(t), the system may need to modify Z to Z" via W as described under Design 3 above. The diagonal gain matrix W may be time variant (i.e., dependent on A(t)), although Z itself is not. Thus, the eventual rotation Z" would be time-variant and will not lead to constant output matrices. In such a case it may be possible to look at several time instants t1, t2, . . . where A(t) may be specified, compute the diagonal gain matrix at each instant of time, and then construct an overall diagonal gain matrix W", for instance, by computing the maximum of gains across time. The constant rotation to be applied is then given by Z"=W'×Z.

Alternatively, one may design the rotation for an intermediate time-instant t between t1 and t2 using either Algorithm 3 or Algorithm 4, and then employ the same rotation at all times instants between t1 and t2. Assuming that the variation in specification A(t) is slow, such a procedure may still lead to very small errors between the required specification and the achieved specification (the sequence of the designed input and output primitive matrices) for the different substreams despite holding the output primitive matrices are held constant.

Although embodiments have been generally described with respect to downmixing operations for use with TrueHD codec formats and adaptive audio content having objects and surround sound channels of various well-known configurations, it should be noted that the conversion of input audio to decoded output audio could comprise downmixing, rendering to the same number of channels as the input, or even upmixing. As stated above, certain of the algorithms contemplate the case where M is greater than N (upmix) and M equals N (straight mix). For example, although Algorithm 1 is described in the context of M<N, further discussion (e.g., Section IV.D alludes to an extension to handle upmixes. Similarly Algorithm 4 is generic with regard to conversion and uses language such as "the smaller of $M_k$, or N," thus clearly contemplating upmixing as well as downmixing.

Embodiments are directed to a matrix decomposition process for rendering adaptive audio content using TrueHD audio codecs, and that may be used in conjunction with a metadata delivery and processing system for rendering adaptive audio (hybrid audio, Dolby Atmos) content, though applications are not so limited. For these embodiments, the input audio comprises adaptive audio having channel-based audio and object-based audio including spatial cues for reproducing an intended location of a corresponding sound source in three-dimensional space relative to a listener. The sequence of matrixing operations generally produces a gain matrix that determines the amount (e.g., a loudness) of each object of the input audio that is played back through a corresponding speaker for each of the N output channels. The adaptive audio metadata may be incorporated with the input audio content that dictates the rendering of the input audio signal containing audio channels and audio objects through the N output channels and encoded in a bitstream between the encoder and decoder that also includes internal channel assignments created by the encoder. The metadata may be selected and configured to control a plurality of channel and object characteristics such as: position, size, gain adjustment, elevation emphasis, stereo/full toggling, 3D scaling factors, spatial and timbre properties, and content dependent settings.

Aspects of the one or more embodiments described herein may be implemented in an audio or audio-visual system that processes source audio information in a mixing, rendering and playback system that includes one or more computers or processing devices executing software instructions. Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

Aspects of the methods and systems described herein may be implemented in an appropriate computer-based sound processing network environment for processing digital or digitized audio files. Portions of the adaptive audio system may include one or more networks that comprise any desired number of individual machines, including one or more routers (not shown) that serve to buffer and route the data transmitted among the computers. Such a network may be built on various different network protocols, and may be the Internet, a Wide Area Network (WAN), a Local Area Network (LAN), or any combination thereof. In an embodiment in which the network comprises the Internet, one or more machines may be configured to access the Internet through web browser programs.

One or more of the components, blocks, processes or other functional components may be implemented through a computer program that controls execution of a processor-based computing device of the system. It should also be noted that the various functions disclosed herein may be described using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, physical (non-transitory), non-volatile storage media in various forms, such as optical, magnetic or semiconductor storage media.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

Throughout this disclosure, including in the claims, the expression performing an operation "on" a signal or data (e.g., filtering, scaling, transforming, or applying gain to, the signal or data) is used in a broad sense to denote performing the operation directly on the signal or data, or on a processed version of the signal or data (e.g., on a version of the signal that has undergone preliminary filtering or pre-processing prior to performance of the operation thereon). The expression "system" is used in a broad sense to denote a device, system, or subsystem. For example, a subsystem that implements a decoder may be referred to as a decoder system, and a system including such a subsystem (e.g., a system that generates Y output signals in response to multiple inputs, in which the subsystem generates M of the inputs and the other Y-M inputs are received from an external source) may also be referred to as a decoder system. The term "processor" is used in a broad sense to denote a system or device programmable or otherwise configurable (e.g., with software or firmware) to perform operations on data (e.g., audio, or video or other image data). Examples of processors include a field-programmable gate array (or other configurable integrated circuit or chip set), a digital signal processor programmed and/or otherwise configured to perform pipelined processing on audio or other sound data, a programmable general purpose processor or computer, and a programmable microprocessor chip or chip set. The expression "metadata" refers to separate and different data from corresponding audio data (audio content of a bitstream which also includes metadata). Metadata is associated with audio data, and indicates at least one feature or characteristic of the audio data (e.g., what type(s) of processing have already been performed, or should be performed, on the audio data, or the trajectory of an object indicated by the audio data). The association of the metadata with the audio data is time-synchronous. Thus, present (most recently received or updated) metadata may indicate that the corresponding audio data contemporaneously has an indicated feature and/or comprises the results of an indicated type of audio data processing. Throughout this disclosure including in the claims, the term "couples" or "coupled" is used to mean either a direct or indirect connection. Thus, if a first device couples to a second device, that connection may be through a direct connection, or through an indirect connection via other devices and connections.

Throughout this disclosure including in the claims, the following expressions have the following definitions: speaker and loudspeaker are used synonymously to denote any sound-emitting transducer. This definition includes loudspeakers implemented as multiple transducers (e.g., woofer and tweeter); speaker feed: an audio signal to be applied directly to a loudspeaker, or an audio signal that is to be applied to an amplifier and loudspeaker in series; channel (or "audio channel"): a monophonic audio signal. Such a signal can typically be rendered in such a way as to be equivalent to application of the signal directly to a loudspeaker at a desired or nominal position. The desired position can be static, as is typically the case with physical loudspeakers, or dynamic; audio program: a set of one or more audio channels (at least one speaker channel and/or at least one object channel) and optionally also associated metadata (e.g., metadata that describes a desired spatial audio presentation); speaker channel (or "speaker-feed channel"): an audio channel that is associated with a named loudspeaker (at a desired or nominal position), or with a named speaker zone within a defined speaker configuration. A speaker channel is rendered in such a way as to be equivalent to application of the audio signal directly to the named loudspeaker (at the desired or nominal position) or to a speaker in the named speaker zone; object channel: an audio channel indicative of sound emitted by an audio source (sometimes referred to as an audio "object"). Typically, an object channel determines a parametric audio source description (e.g., metadata indicative of the parametric audio source description is included in or provided with the object channel). The source description may determine sound emitted by the source (as a function of time), the apparent position (e.g., 3D spatial coordinates) of the source as a function of time, and optionally at least one additional parameter (e.g., apparent source size or width) characterizing the source; and object based audio program: an audio program comprising a set of one or more object channels (and optionally also comprising at least one speaker channel) and optionally also associated metadata (e.g., metadata indicative of a trajectory of an audio object which emits sound indicated by an object channel, or metadata otherwise indicative of a desired spatial audio presentation of sound indicated by an object channel, or metadata indicative of an identification of at least one audio object which is a source of sound indicated by an object channel).

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

The invention claimed is:

1. A method of decomposing a multi-dimensional matrix into a sequence of unit primitive matrices and a permutation matrix, comprising:

receiving in a processor of a signal processing system, a matrix of dimension L-by-N, where L is less than or equal to N, wherein the L-by-N matrix is equivalent to an $M_0$-by-N matrix $A_0$ rotated by applying an L-by-$M_0$ rotation matrix Z, wherein L is less than or equal to $M_0$, and wherein the rotation matrix Z is designed to:

minimize cross correlation between the columns of the rotated L-by-N matrix, or minimize the 12 norm of the columns of the rotated L-by-N matrix, or minimize the absolute value of coefficients in the N-by-N primitive matrices, wherein the $M_0$-by-N matrix $A_0$ is a time-varying matrix configured to adapt to changing spatial metadata;

deriving from the L-by-N matrix a sequence of N-by-N unit primitive matrices and a permutation matrix, wherein an N-by-N unit primitive matrix is defined as a matrix in which N−1 rows contain off-diagonal elements equal to zero and on-diagonal elements with an absolute value of 1, wherein the product of the unit primitive matrices and the permutation matrix contains L rows that approximate the L-by-N matrix; and configuring the permutation matrix and indices of non-trivial rows in the unit primitive matrices such that the absolute coefficient values in the unit primitive matrices are limited with respect to a maximum allowed coefficient value of the signal processing system;

wherein the matrix $A_0$ at a first time instant $t_1$ is different from the matrix $A_0$ at a second time instant $t_2$, and the matrix Z at the first time instant $t_1$ is equal to the matrix Z at the second time instant $t_2$.

2. The method of claim 1 wherein the process of deriving the sequence of primitive matrices and the permutation matrix is iterative, and further comprising:

defining the permutation matrix to be an identity matrix initially;

iteratively modifying the L-by-N matrix to account for the configured primitive matrices and the permutation matrix up to a previous iteration to generate a modified L-by-N matrix;

in each iteration selecting a subset of rows of the modified L-by-N matrix; and constructing a subset of the primitive matrices, and reordering at least some of the columns of the permutation matrix so that the product of the primitive matrices and permutation matrix contains rows that approximate the chosen subset of rows in the modified L-by-N matrix.

3. The method of claim 2, wherein the process of choosing the columns of the permutation matrix that are to be reordered involves comparing determinants of sub-matrices of the modified L-by-N matrix and choosing the ordering that yields a determinant that is larger than a threshold dependent on the maximum allowed coefficient value.

4. The method of claim 3, wherein the columns of the permutation matrix are chosen to yield the largest determinant, and/or wherein the reordering of the columns of the permutation matrix additionally depends on maximizing the absolute values of determinants that are evaluated in subsequent iterations.

5. The method of claim 3, wherein the subset of rows of the modified L-by-N matrix is determined by comparing determinants of sub-matrices of the L-by-N matrix and choosing rows that ensure the existence of determinants larger than the threshold when the ordering of columns of the permutation matrix is determined.

6. The method of claim 1, wherein the rotation matrix Z is constructed such that each linear transformation in a hierarchy of linear transformations $A_0$ to $A_1$ to $A_2$ so on to $A_{K-1}$ for K greater than or equal to one, of the matrix $A_0$, is achieved by linearly combining a continuous series of rows of the rotated L-by-N matrix.

7. The method of claim 6, wherein the matrices $A_k$ for k greater than or equal to zero and k less than K, are of dimensions $M_k$-by-$M_{k-1}$ and the rank of $A_k$ is $M_k$, and the rotation matrix Z is constructed by stacking up subsets of rows in a sequence of matrix products comprising:

$$A_{k-1}*\ldots*A_2*A_1*I,\ldots$$
$$A_k*\ldots*A_2*A_1*I,\ldots$$
$$A_1*I,$$
$$I,$$

wherein I is the identity matrix of dimension $M_0$-by-$M_0$.

8. The method of claim 6, wherein the construction of the rotation matrix Z is an iterative procedure, the method further comprising:

generating the matrix product $Ak*A_{k-1}*\ldots*A_2*A_1*A_0$ of one matrix sequence A0, A1, . . ., Ak per iteration, starting from the deepest sequence where k equals K−1;

determining a kth set of vectors that span the row space of the one sequence product that is orthogonal to the row space of the product of a partial rotation Z determined in a previous iteration and the first rendering matrix $A_0$; and augmenting the rotation matrix Z with rows that, when multiplied with $A_0$, results in vectors that approximatethe $k^{th}$ set of vectors.

9. The method of claim 8, where the $k^{th}$ set of vectors are orthonormal to each other, and/or wherein the process of determining the $k^{th}$ set of vectors involves a singular value decomposition.

10. The method of claim 6, wherein the rotation matrix is designed to effectively apply a gain on one or more rows of a resulting L-by-N matrix so that the coefficients in the primitive matrices of the decomposition are limited in value.

11. The method of claim 6, wherein the maximum allowed coefficient value comprises a maximum value that can be represented in a syntax of a bitstream that transports the primitive matrices within an encoder/decoder circuit of the signal processing system.

12. The method of claim 6, wherein the method of decomposing is part of a high definition audio encoder wherein the permutation matrix represents a channel assignment that reorders N input channels, the method further comprising:

applying the N-by-N primitive matrices to the reordered N input audio channels to create internal channels encoded into the bitstream; and receiving at least a portion of the internal channels to losslessly recover, when required, the N input channels from the internal channels.

13. The method of claim 12, wherein the sequence product $A_k*A_{k-1}*\ldots*A_2*A_1*A_0$, for each k, represents a rendering matrix that linearly transforms N input channels into $M_k$ presentation channels, and the $M_k$-channel presentation may be obtained by output matrices in the bitstream applied only to a subset of the set of internal channels.

14. The method of claim 13, wherein the output matrices corresponding to one or more presentation in the sequence are in a legacy bitstream format that is compatible with legacy decoding devices, while at least the input primitive matrices conform to a different bitstream syntax.

15. The method of claim 12, wherein the matrices $A_0$, $A_1$ to $A_{K-1}$ are rendering matrices specified at time t1, and a second set of matrices $B_0$, $B_1$ to $B_{k-1}$, are rendering matrices specified at time t2, where $B_0$ is the same dimension as $A_0$, and $B_1$ to $B_{K-1}$ approximate $A_1$ to $A_{K-1}$ respectively, and further wherein an L-by-N matrix is constructed both at time t1 and t2, by applying the same rotation Z on $A_0$ and $B_0$ respectively, a decomposition of the L-by-N matrix into N*N primitive matrices and a channel assignment is determined at both t1 and t2, and a single set of output matrices is determined that transforms internal channels to presentation channels for each presentation at both instants of time t1 and t2.

16. The method of claim 15 wherein the number of primitive matrices, channel assignment, and the index of the non-trivial rows in the primitive matrices is exactly the same at both t1 and t2, and primitive matrices at intermediate time instants are derived by interpolating the primitive matrices at time t1 and t2, and/or wherein the rotation Z is determined based on the specified matrices $A_0$ , $A_1$ to $A_{k-1}$ at time t1 and reused at time t2.

17. A system for decomposing a multi-dimensional matrix into a sequence of unit primitive matrices and a permutation matrix, comprising:

a receiver stage of the system receiving a matrix of dimension L-by-N, where L is less than or equal to N, wherein the L-by-N matrix is equivalent to an $M_0$-by-N matrix $A_0$ rotated by applying an L-by-$M_0$ rotation matrix Z, wherein L is less than or equal to $M_0$ and wherein the rotation matrix Z is designed to:

minimize cross correlation between the columns of the rotated L-by-N matrix, or minimize the 12 norm of the columns of the rotated L-by-N matrix, or minimize the absolute value of coefficients in the N-by-N primitive matrices, wherein the $M_0$-by-N matrix $A_0$ is a time-varying matrix configured to adapt to changing spatial metadata;

and a processor of the system deriving from the L-by-N matrix a sequence of N-by-N unit primitive matrices and a permutation matrix, wherein an N-by-N unit primitive matrix is defined as a matrix in which N−1 rows contain off-diagonal elements equal to zero and on-diagonal elements with an absolute value of 1,wherein the product of the primitive matrices and the permutation matrix contains L rows that approximate the L-by-N matrix, wherein the permutation matrix and indices of non-trivial rows in the primitive matrices are configured such that the absolute coefficient values in the primitive matrices are limited with respect to a maximum allowed coefficient value of the system, wherein the matrix $A_0$ at a first time instant $t_1$ is different from the matrix $A_0$ at a second time instant $t_2$, and the matrix Z at the first time instant $t_1$ is equal to the matrix Z at the second time instant $t_2$.

18. The system of claim 17 wherein the processor derives the sequence of primitive matrices and the permutation matrix iteratively by: defining the permutation matrix to be an identity matrix initially and iteratively modifying the L-by-N matrix to account for the configured primitive matrices and the permutation matrix up to a previous iteration to generate a modified L-by-N matrix, and in each iteration selecting a subset of rows of the modified L-by-N matrix, then constructing a subset of the primitive matrices, and reordering at least some of the columns of the permutation matrix so that the product of the primitive matrices and permutation matrix contains rows that approximate the chosen subset of rows in the modified L-by-N matrix.

19. The system of claim 17, wherein the rotation matrix Z is constructed such that each linear transformation in a hierarchy of linear transformations $A_0$ to $A_1$ to $A_2$ so on to $A_{k-1}$ for K greater than or equal to one, of the matrix $A_0$, is achieved by linearly combining a continuous series of rows of the rotated L-by-N matrix.

20. A system comprising:

an encoder component configured to receive audio comprising N input channels or objects, determine one or more time-varying downmix specifications, decompose a multi-dimensional matrix into a sequence of unit primitive matrices and a permutation matrix by receiving a matrix of dimension L-by-N, where L is less than or equal to N, wherein the L-by-N matrix is equivalent to an $M_0$-by-N matrix $A_0$ rotated by applying an L-by-$M_0$ rotation matrix Z, wherein L is less than or equal to $M_0$, and wherein the rotation matrix Z is designed to:

minimize cross correlation between the columns of the rotated L-by-N matrix, or minimize the 12 norm of the columns of the rotated L-by-N matrix, or minimize the absolute value of coefficients in the N-by-N primitive matrices, wherein the $M_0$-by-N matrix $A_0$ is a time-varying matrix configured to adapt to changing spatial metadata;

deriving from the L-by-N matrix a sequence of N-by-N unit primitive matrices and a permutation matrix, wherein an N-by-N unit primitive matrix is defined as a matrix in which N−1 rows contain off-diagonal elements equal to zero and on-diagonal elements with an absolute value of 1, wherein the product of the unit primitive matrices and the permutation matrix contains L rows that approximate the L-by-N matrix, and configuring the permutation matrix and indices of non-trivial rows in the primitive matrices such that the absolute coefficient values in the primitive matrices are limited with respect to a maximum allowed coefficient value of the signal processing system;

wherein the matrix $A_0$ at a first time instant $t_1$ is different from the matrix $A_0$ at a second time instant $t_2$, and the matrix Z at the first time instant $t_1$ is equal to the matrix Z at the second time instant $t_2$;

the encoder further configured to apply the decomposed permutation matrix and inverses of the primitive matrices to the N input channels or objects to produce the internal channels, determine a downmix permutation matrix and one or more downmix matrices for each of one of more downmix formats, losslessly encode the internal channels, and pack the permutation matrix, the primitive matrices, the encoded internal channels, and the downmix permutation matrix and downmix matrices for each of the one or more downmix formats into a bitstream comprising two or more substreams; and a decoder coupled to the encoder and configured to receive the bitstream comprising two or more substreams, and either:

extract the internal channels, the permutation matrix, and the primitive matrices, losslessly decode the internal channels, and apply the primitive matrices and permutation matrix to the internal channels to losslessly reproduce the N input channels and/or objects; or extract a subset of the internal channels, a downmix permutation matrix and one or more downmix matrices, and apply the downmix matrices and the downmix permutation matrix to the subset of the internal channels to reproduce a downmix of the N input channels and/or objects.

* * * * *